United States Patent [19]

Kitaguchi et al.

[11] Patent Number: 4,678,735

[45] Date of Patent: Jul. 7, 1987

[54] HEAT DEVELOPABLE LIGHT-SENSITIVE MATERIAL WITH DEVELOPMENT INHIBITOR RELEASER

[75] Inventors: Hiroshi Kitaguchi; Masatoshi Kato; Kozo Sato; Masasi Takeuchi; Masaaki Tsukase, all of Kanagaw, Japan

[73] Assignee: Fuji Photo Film Co., Ltd., Kanagawa, Japan

[21] Appl. No.: 774,427

[22] Filed: Sep. 10, 1985

[30] Foreign Application Priority Data

Sep. 11, 1984 [JP] Japan ..... 59-190173
Feb. 13, 1985 [JP] Japan ..... 60-26038

[51] Int. Cl.[4] ..... G03C 5/54; G03C 1/34

[52] U.S. Cl. ..... 430/203; 430/353; 430/611; 430/617; 430/619; 430/957; 430/960

[58] Field of Search ..... 430/203, 611, 617, 619, 430/957, 960, 544, 353

[56] References Cited

U.S. PATENT DOCUMENTS

| | | | |
|---|---|---|---|
| 3,674,478 | 7/1972 | Grasshoff et al. | 430/219 |
| 3,801,330 | 4/1974 | Brinckman et al. | 430/617 |
| 3,877,940 | 4/1975 | Ericson | 430/617 |
| 4,550,071 | 10/1985 | Aono et al. | 430/617 |

OTHER PUBLICATIONS

Carpenter et al., "Photothermographic Silver Halide Systems", *Research Disclosure* No. 17029, 6/1978, pp. 9–15.

*Primary Examiner*—Richard L. Schilling
*Attorney, Agent, or Firm*—Sughrue, Mion, Zinn, Macpeak and Seas

[57] ABSTRACT

A heat developable light-sensitive material containing a compound represented by general formula (I) described below in a light-sensitive layer or an image receiving layer thereof:

(I)

wherein X represents an atomic group necessary to complete a benzene ring or a naphthalene ring; R represents a group convertible to a hydroxy group or a dissociation form thereof at the time of heat development; Y represents an atomic group necessary to complete a 5-membered or 6-membered heterocyclic group containing at least one nitrogen atom; Q represents a hydrogen atom, an alkyl group, a substituted alkyl group, an aryl group, or a substituted aryl group; TIME represents a timing group; and n represents 0 or a positive integer. The heat developable light-sensitive material containing the compound represented by general formula (I), which is stable at room temperature and releases a development inhibitor to stop the development at the time of heat development, can provide a color image having a high S/N ratio and a high density.

9 Claims, No Drawings

HEAT DEVELOPABLE LIGHT-SENSITIVE MATERIAL WITH DEVELOPMENT INHIBITOR RELEASER

FIELD OF THE INVENTION

The present invention relates to a heat developable light-sensitive material, particularly to a heat developable light-sensitive material which has stable photographic properties after development processing.

BACKGROUND OF THE INVENTION

Photographic processes using silver halide have been widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly providing images have been developed by changing the conventional wet process using a developing solution into a dry development process such as a process using heat, etc.

Heat developable light-sensitive materials are thus well known in this field. Heat developable light-sensitive materials and processes therefor have been described, for example, in *Shashin Kogaku no Kiso* (*The Foundation of Photographic Technology*), pages 553–555 (published by Corona Co., 1979), *Eizo Joho* (*The Image Information*), page 40 (April, 1978), *Nebletts Handbook of Photography and Reprography,* 7th Ed., pages 32–33 (Van Nostrand Reinhold Company), U.S. Pat. Nos. 3,152,904, 3,301,678, 3,392,020 and 3,457,075, British Pat. Nos. 1,131,108 and 1,167,777 and *Research Disclosure,* No. 17029, pages 9–15 (June, 1978).

Many different processes for obtaining color image have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31–32 (September 1975) and the combination of a sulfonamidophenol type reducing agent and a 4-equivalent coupler as described in U.S. Pat. No. 4,021,240.

Also, processes and materials for forming a positive color image by a light-sensitive silver dye bleach process are described, for example, in *Research Disclosure,* No. 14433, pages 30–32 (April, 1976), ibid., No. 15227, pages 14–15 (December, 1976) and U.S. Pat. No. 4,235,957, etc.

Further, processes for forming images upon heat development utilizing compounds having a dye moiety which are capable of releasing a mobile dye in correspondence or counter-correspondence to the reduction reaction of silver halide to silver under high temperature conditions have been described, for example, in European Patent Application (OPI) Nos. 76,492 and 79,056, Japanese Patent Application (OPI) Nos. 28928/83 and 26008/83 (the term "OPI" as used herein refers to a "published unexamined Japanese patent application"), etc.

With these heat developable light-sensitive materials development is conducted by heating using a base as a development accelerator in most cases. However, light-sensitive materials once heated at high temperature take a substantial time to decrease in temperature, resulting in overdevelopment or deterioration of image quality. Further, it is possible for development to occur beyond the desired level depending on subtle variations in conditions such as the ambient temperature, the temperature of heating, the moisture content of the light-sensitive material, the time of heating, etc., even when the same pattern of heating is employed.

In order to eliminate such a phenomenon, it has been proposed to use acid polymers for neutralization as described in *Research Disclosure,* Vol. 123, page 22, ibid., Vol. 180, page 18030 in a diffusion transfer process. In heat developable light-sensitive materials, however, they cause a reduction in the density of the image obtained because the bases are rapidly neutralized. Further, some compounds are known which release acids when heated. For example, in Japanese Patent Application (OPI) Nos. 58642/74 and 57452/75, there are disclosed acid components which at a temperature of at least 60° C. are dissolved or release volatile acids. However, since the compounds disclosed in these patent applications neutralize the bases before development is started by heating, development is restrained and the density of the image obtained is reduced.

SUMMARY OF THE INVENTION

It is an object of the present invention to provide a novel heat developable light-sensitive material which has the effect of stopping development when the development has appropriately proceeded without reducing the density of the resulting image.

More specifically, one object of the present invention is to provide a heat developable light-sensitive material containing a compound which is stable at room temperature and has a function of stopping development upon releasing a development inhibitor at the time of heat development.

Another object of the present invention is to provide a heat developable light-sensitive material which provides an image having a high S/N ratio and high image density.

Other objects of the present invention will become apparent from the following detailed description and examples.

These objects of the present invention are achieved by a heat developable light-sensitive material containing a compound represented by general formula (I) described below in a light-sensitive layer or an image receiving layer thereof.

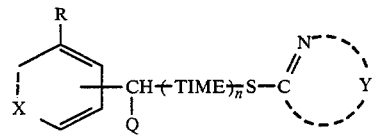

(I)

wherein X represents an atomic group necessary to complete a benzene ring or a naphthalene ring; R represents a group convertible to a hydroxy group or a dissociation form thereof at the time of heat development; Y represents an atomic group necessary to complete a 5-membered or 6-membered heterocyclic group containing at least one nitrogen atom; Q represents a hydrogen atom, an alkyl group, a substituted alkyl group, an aryl group or a substituted aryl group; TIME represents a timing group; and n represents 0 or a positive integer.

DETAILED DESCRIPTION OF THE INVENTION

The compound represented by general formula (I) used in the present invention will be described in detail in the following.

While X can represent an atomic group necessary to complete a benzene ring or a naphthalene ring in general formula (I), it is preferred that X represents an atomic group necessary to complete a benzene ring. When X represents an atomic group necessary to complete a benzene ring, the group represented by

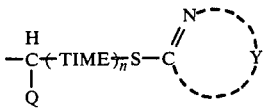

is preferably present at an ortho position or a para position with respect to R.

The atomic group which constitutes the benzene ring or naphthalene ring may be substituted with an appropriate substituent other than a hydrogen atom. Examples of the substituents which can be positioned on the benzene ring or naphthalene ring include a halogen atom, an alkyl group, an aryl group, a heterocyclic group, a cyano group, an alkoxy group, an aryloxy group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, a silyloxy group, an aryloxycarbonylamino group, an imido group, a heterocyclic thio group, a sulfinyl group, a phosphonyl group, an aryloxycarbonyl group or an acyl group, etc.

Of the groups convertible to a hydroxy group or a dissociation form thereof at the time of heat development represented by R, the following groups represented by the formula (A), (B) or (C) are preferred.

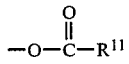

(A)

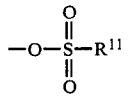

(B)

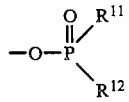

(C)

wherein $R^{11}$ and $R^{12}$, which may be the same or different, each represents a group selected from a substituted or unsubstituted alkyl group, a cycloalkyl group, a substituted or unsubstituted alkenyl group, an aralkyl group, a substituted or unsubstituted aryl group, a heterocyclic group, an alkoxy group, an aryloxy group, an alkylthio group, an arylthio group and a substituted or unsubstituted amino group, or $R^{11}$ and $R^{12}$ may be connected to each other to form a 5-membered or 6-membered ring.

In $R^{11}$ and $R^{12}$, a preferred alkyl group is a straight chain or branched chain alkyl group having from 1 to 18 carbon atoms. Specific examples include a methyl group, an ethyl group, an n-propyl group, an n-butyl group, an n-hexyl group, an n-heptyl group, a 2-ethylhexyl group, an n-decyl group, an n-dodecyl group etc.

Substituents on the substituted alkyl group include, for example, a halogen atom, an alkoxy group, an aryloxy group, a cyano group, an alkylthio group, an arylthio group, a substituted or unsubstituted carbamoyl group, an alkylsulfonyl group, an arylsulfonyl group, a disubstituted amino group substituted with an alkyl group or an aryl group, a hydroxy group, a carboxy group, a sulfo group, an acylamino group, or a sulfonylamino group, etc.

In $R^{11}$ and $R^{12}$, a preferred cycloalkyl group is a 5-membered or 6-membered cycloalkyl group having from 5 to 10 carbon atoms. Specific examples include a cyclopentyl group, a cyclohexyl group, etc.

The cycloalkyl group may be substituted with the substituents defined for the above described substituted alkyl group.

Specific examples of the alkenyl groups include a vinyl group, an allyl group, a crotyl group, a substituted or unsubstituted styryl group, etc.

The alkenyl group may be substituted with the substituents defined for the above described substituted alkyl group.

In $R^{11}$ and $R^{12}$, a preferred aryl group is an aryl group having from 6 to 18 carbon atoms. Specific examples include a phenyl group, a naphthyl group, an anthryl group, etc. Substituents on the substituted aryl group include, for example, a substituted or unsubstituted alkyl group, a substituted or unsubstituted alkoxy group, a substituted or unsubstituted aryl group, a halogen atom, an acylamino group, a sulfonylamino group, a cyano group, a nitro group, an alkylthio group, an arylthio group, an alkylsulfonyl group, an arylsulfonyl group, a carbonyloxy group, a hydroxy group, a substituted or unsubstituted carbamoyl group, a substituted or unsubstituted sulfamoyl group, a disubstituted amino group substituted with an alkyl group or an aryl group, a carboxy group, a sulfo group, an alkyloxycarbonyl group, or an aryloxycarbonyl group, etc.

Specific examples of the aralkyl groups include a benzyl group, a $\beta$-phenethyl group, etc. The aralkyl group may be substituted with the substituents defined for the above described substituted aryl group.

In $R^{11}$ and $R^{12}$, a preferred heterocyclic group is a 5-membered or 6-membered heterocyclic group containing an oxygen atom, a nitrogen atom or a sulfur atom as a hetero atom. Specific examples of the heterocyclic group include a pyridyl group, a furyl group, a thienyl group, a pyrrole group, an indolyl group, etc. The heterocyclic group may be substituted with the substituents defined for the above described substituted aryl group.

In $R^{11}$ and $R^{12}$, a preferred alkoxy group, aryloxy group, alkylthio group or arylthio group is represented by the following formula (D) or (E):

$$-O-R^{13} \quad \text{(D)}$$

$$-S-R^{14} \quad \text{(E)}$$

wherein $R^{13}$ and $R^{14}$ each represents an alkyl group or an aryl group.

Preferred examples of the alkyl group or aryl group for $R^{13}$ or $R^{14}$ are the same as those described for $R^{11}$ or $R^{12}$ above. Further, the alkyl group or aryl group for $R^{13}$ or $R^{14}$ may be substituted with a substituent selected from those described for $R^{11}$ or $R^{12}$.

Of the groups represented by the formula (A), (B) or (C), those represented by the formula (A) are preferred. Further, the case wherein $R^{11}$ in the formula (A) represents an aryl group or a substituted aryl group is most preferred.

Q represents a hydrogen atom, an alkyl group, a substituted alkyl group, an aryl group or a substituted aryl group.

In Q, a preferred alkyl group is a straight chain or branched chain alkyl group having from 1 to 18 carbon atoms. Specific examples include a methyl group, an ethyl group, an n-propyl group, an n-butyl group, an n-hexyl group, an n-heptyl group, a 2-ethylhexyl group, an n-decyl group, an n-dodecyl group, etc.

Substituents on th substituted alkyl group include, for example, a halogen atom, an alkoxy group, an aryloxy group, a cyano group, an alkylthio group, an arylthio group, a substituted or unsubstituted carbamoyl group, an alkylsulfonyl group, an arylsulfonyl group, a disubstituted amino group substituted with an alkyl group or an aryl group, a hydroxy group, a carboxy group, a sulfo group, an acylamino group, or a sulfonylamino group, etc.

In Q, a preferred aryl group is an aryl group having from 6 to 18 carbon atoms. Specific examples include a phenyl group, a naphthyl group, an anthryl group, etc. Substituents on the substituted aryl group include, for example, a substituted or unsubstituted alkyl group, a substituted or unsubstituted alkoxy group, a substituted or unsubstituted aryl group, a halogen atom, an acylamino group, a sulfonylamino group, a cyano group, a nitro group, an alkylthio group, an arylthio group, an alkylsulfonyl group, an arylsulfonyl group, a carbonyloxy group, a hydroxy group, a substituted or unsubstituted carbamoyl group, a substituted or unsubstituted sulfamoyl group, a disubstituted amino group substituted with an alkyl group or an aryl group, a carboxy group, a sulfo group, an alkyloxycarbonyl group, or an aryloxycarbonyl group, etc.

Q may be connected with

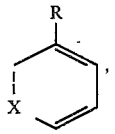

TIME or

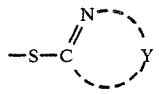

directly or through another atom(s).

TIME represents a timing group. Typical examples of the timing group are

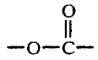

group described in Japanese Patent Publication No. 9696/80, Japanese Patent Application (OPI) Nos. 1139/83, 1140/83, or —$OCH_2$— group described in Japanese Patent Application (OPI) No. 93442/84, etc.

n represents 0 or a positive integer such as 1 or 2.

Preferred examples of the 5-membered or 6-membered heterocyclic ring containing at least one nitrogen atom which is represented by

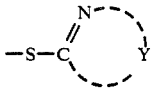

include the following:

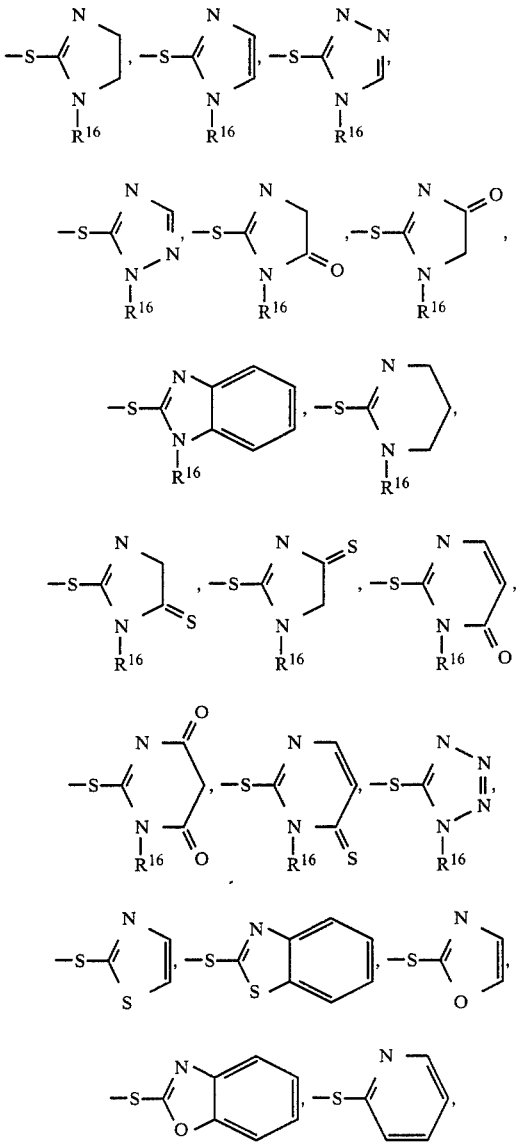

-continued

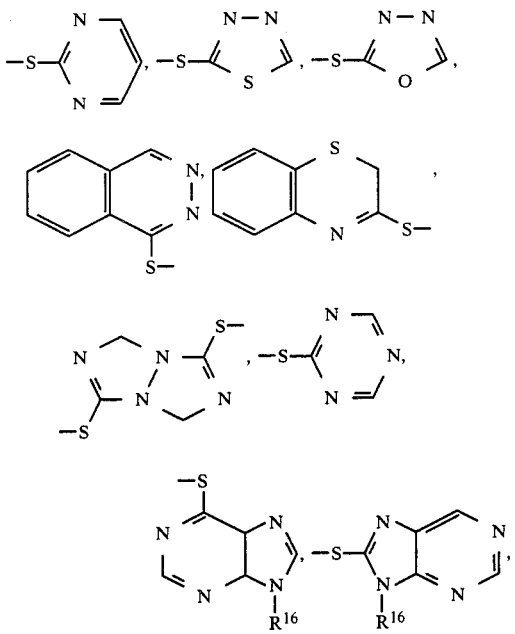

wherein $R^{16}$ represents a group selected from a hydrogen atom, an alkyl group, an aryl group, a cycloalkyl group, an alkenyl group and an aralkyl group. These groups may have an appropriate substituent, examples of which include those described for $R^{11}$. Further, the carbon atoms which constitutes the above described ring may be substituted with a substituent other than a hydrogen atom and typical examples of which include those described for the benzene ring or naphthalene ring above.

Although the compound according to the present invention is stable at room temperature under neutral conditions, at the time of heat development the group represented by R is converted to a hydroxy group or a dissociated form thereof and it releases a development inhibitor (II) and at the same time a quinonemethide (III) is formed in accordance with the following reaction scheme I.

Reaction Scheme I

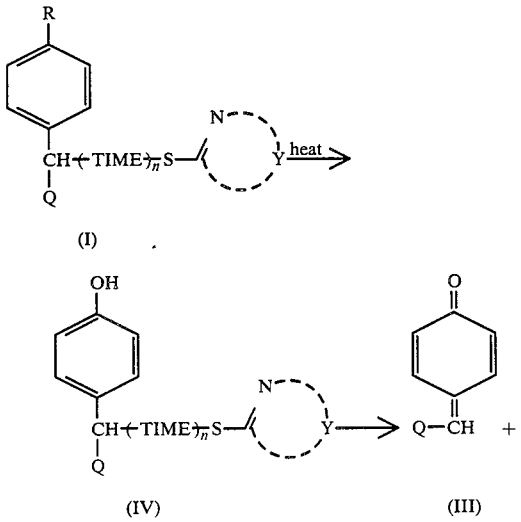

-continued

Reaction Scheme I

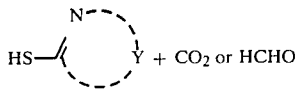

(II)

(When TIME represents

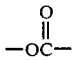

group, $CO_2$ is formed and when TIME represents —$OCH_2$— group, HCHO is formed in Scheme I.)

It is known that the compound represented by general formula (I) wherein —R represents

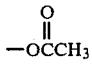

and Q represents a hydrogen is hydrolyzed in an aqueous alkaline medium to form a phenol and then a quinonemethide is formed and at the same time a photographic reagent is released as described in U.S. Pat. No. 3,674,478. However, it has now been found for the first time that the compound represented by general formula (I) efficiently releases a development inhibitor at the time of heat development in a heat developable light-sensitive material which does not substantially contain water because of a dry process and in the absence of alkali. This fact is wholly unexpected from the above described reference.

Further, it has also been found that the rate of releasing a development inhibitor can be accelerated by introducing an aryl group or a substituted aryl group as a substituent Q over that of the compounds of the formula (I) wherein Q is a hydrogen atom. This is believed to be attributable to stabilization of the produced quinonemethide (III) by introducing an aryl group or a substituted aryl group in Q. That is, the efficiency of release of a development inhibitor from the compound (IV) produced upon heat development or heat transfer can be heightened, resulting in success of ensuring manifestation of the above described development inhibitory effect.

In order to regenerate a hydroxy group from the group of (A), (B) or (C) which has been found as a preferred example for R, it is generally necessary to suppose an attack of a nucleophilic reagent. Although it is not clear what does act as a nucleophilic reagent, it is assumed that various kinds of terminal groups (for example, —$NH_2$, —OH, —$CO_2H$, —SH,

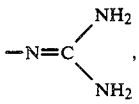

etc.) of amino acids constituting gelatin which is used as a binder function as nucleophilic reagents. While the reaction of these terminal groups with the compounds represented by general formula (I) is extremely slow, it is believed that the reaction is accelerated due to the high temperature processing in the heat developable light-sensitive material, whereby the release of the compound represented by formula (II) becomes possible.

The rate of this reaction can widely vary depending on the protective group R for the hydroxy group. For example, in the case wherein —R represents $$-\overset{O}{\overset{\|}{O}}CR^{11},$$

when $R^{11}$ represents a substituted or unsubstituted aryl group, it is easy to receive the nucleophilic attack in comparison with when $R^{11}$ represents an alkyl group, advantageously resulting in an easier release of the compound of formula (II).

It is also known that the nitrogen-containing heterocyclic compound having a mercapto group represented by formula (II) exerts a development inhibiting effect. However, when the compound represented by formula (II) is incorporated into an emulsion layer from the beginning, development is restrained in the early stage of development whereby the image density obtained is decreased and also the sensitivity is reduced. On the contrary, since the compound represented by general formula (I) gradually releases the development inhibitor of formula (II) on the course of heat development, it is possible to terminate development without the decrease in image density.

Moreover, in heat developable light-sensitive materials, a base is often employed as a development accelerator. In such a case, the base acts as a nucleophilic reagent at the time of heat development to accelerate the release of the development inhibitor of formula (II). Therefore, it is particularly advantageous to use a base or a base precursor together with the compound represented by general formula (I) according to the present invention.

Specific examples of the compounds represented by general formula (I) are set forth below, but the present invention should not be construed as being limited to these compounds.

(1)

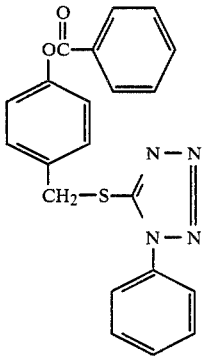

-continued (2)

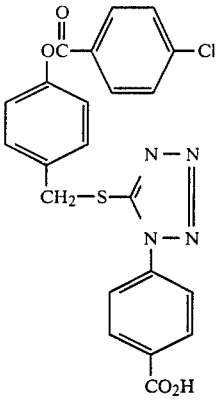

(3)

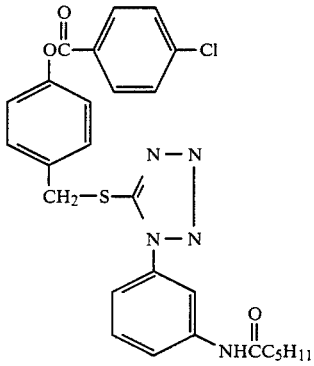

(4)

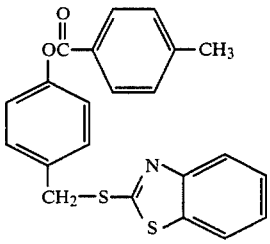

(5)

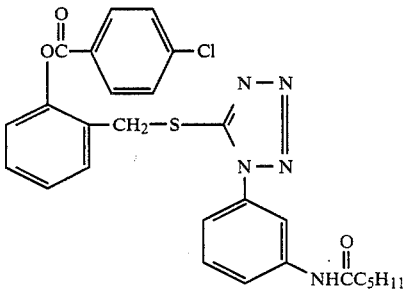

-continued
(6)
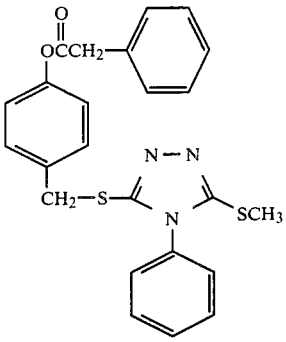
(7)
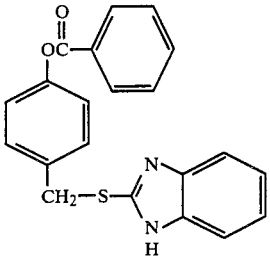
(8)
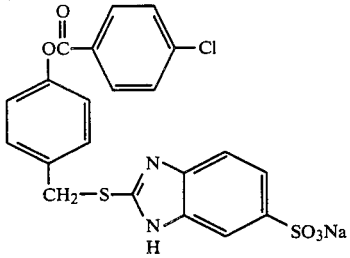
(9)
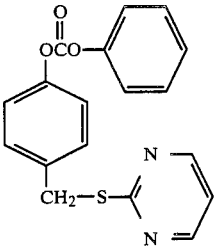
(10)
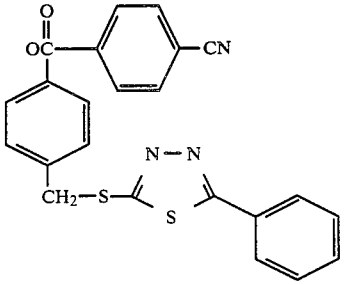
-continued
(11)
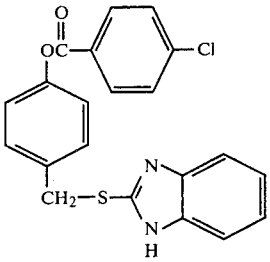
(12)
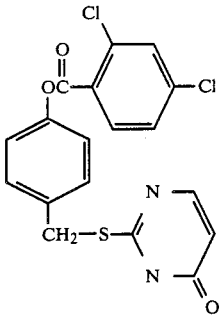
(13)
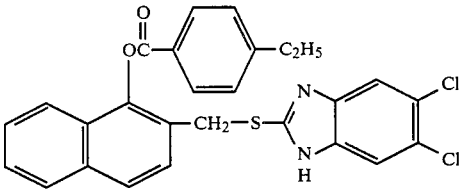
(14)
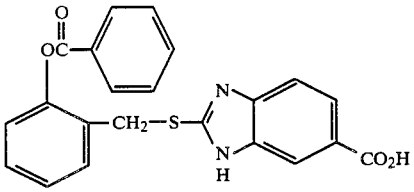
(15)
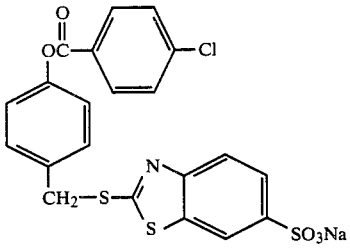
(16)
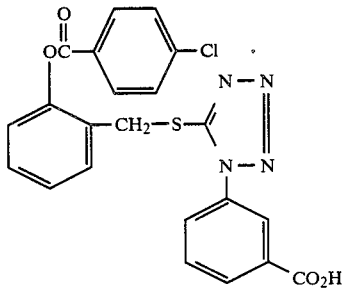

-continued
(17)
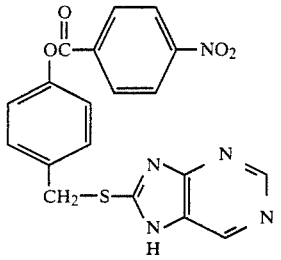
(18)
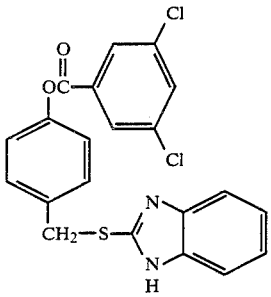
(19)
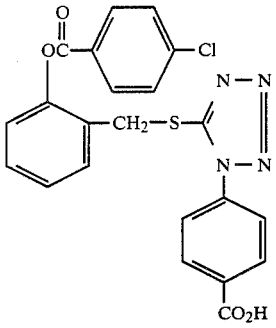
(20)
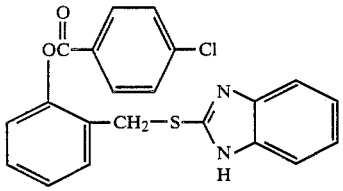
(21)
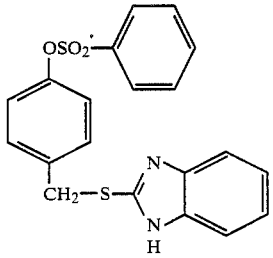
-continued
(22)
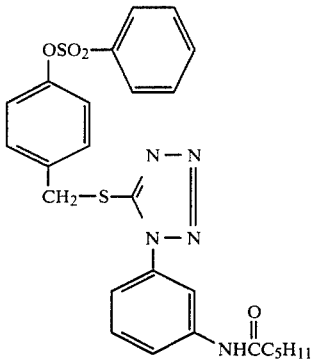
(23)
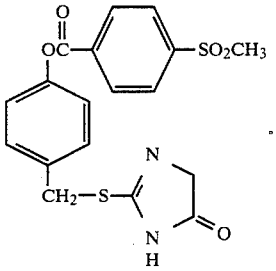
(24)
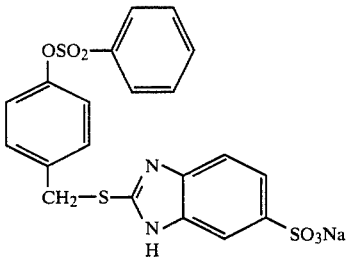
(25)
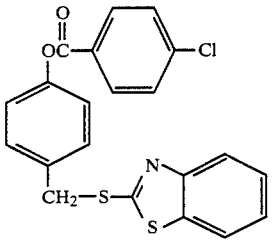
(26)
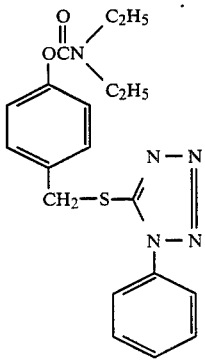

-continued
(27)
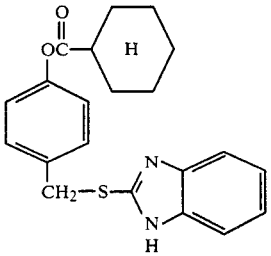
(28)
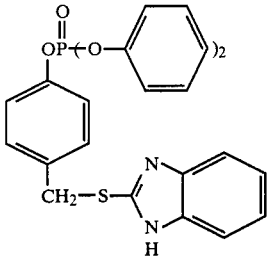
(29)
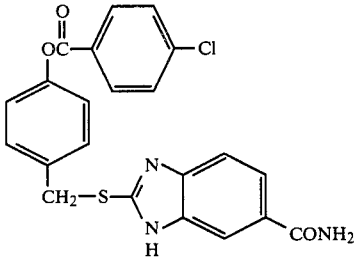
(30)
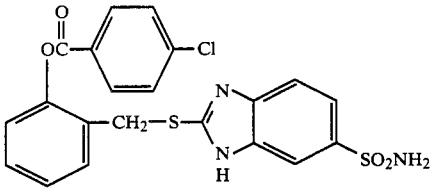
(31)
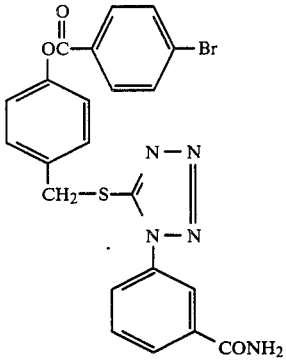
(32)
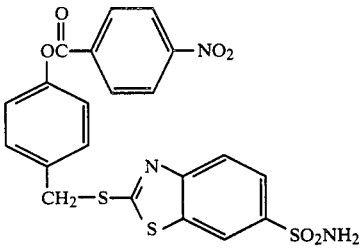
-continued
(33)
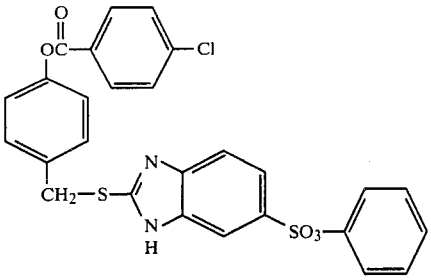
(34)
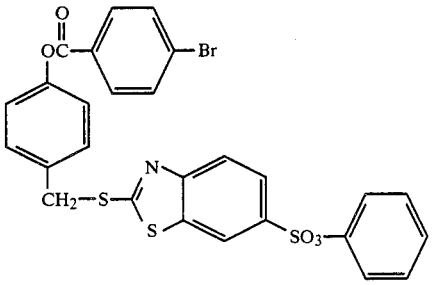
(35)
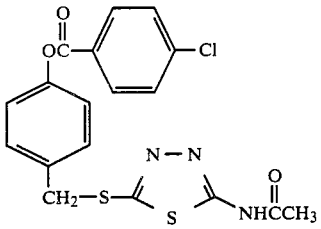
(36)
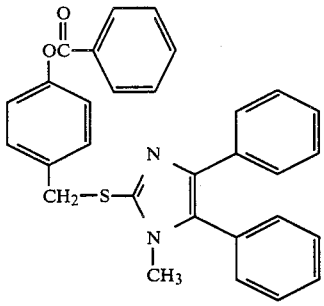
(37)
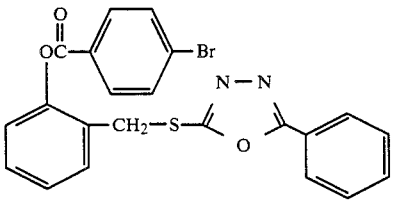

-continued
(38)
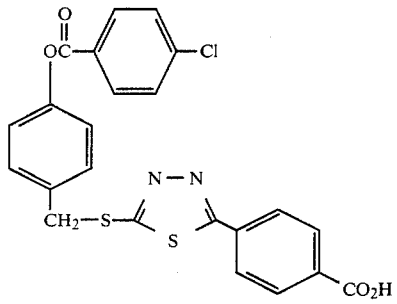
(39)
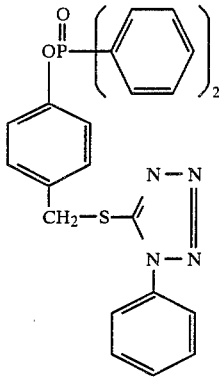
(40)
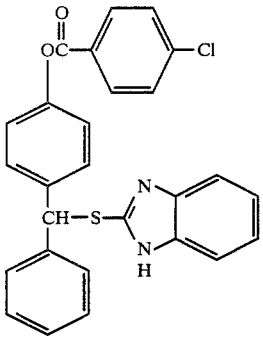
(41)
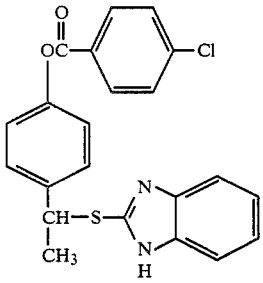
(42)
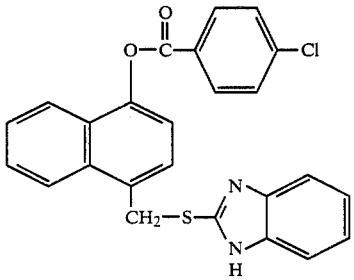
-continued
(43)
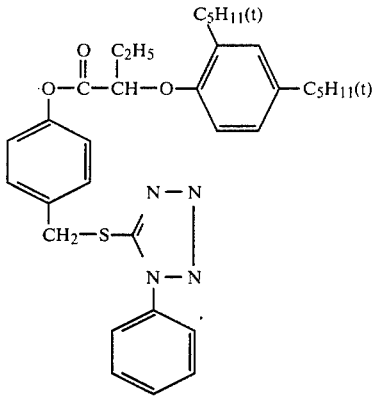
(44)
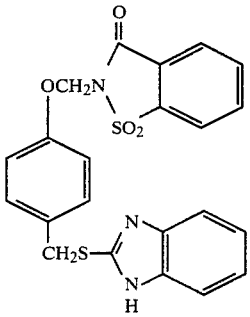
(45)
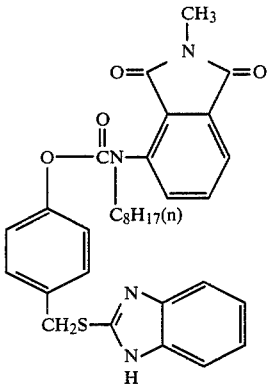
(46)
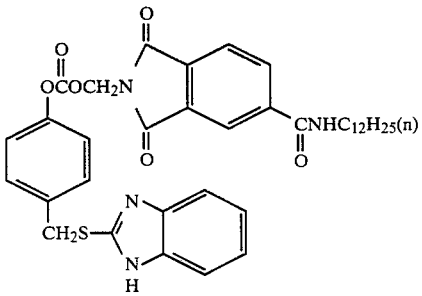

-continued
(47)
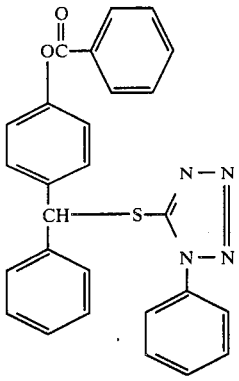
(48)
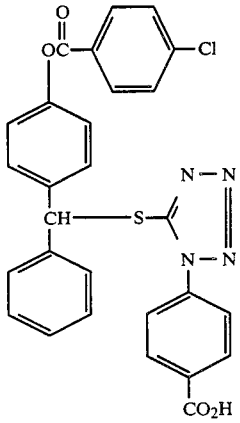
(49)
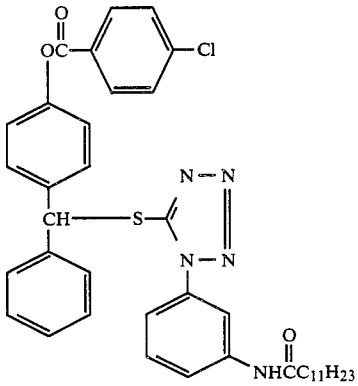
(50)
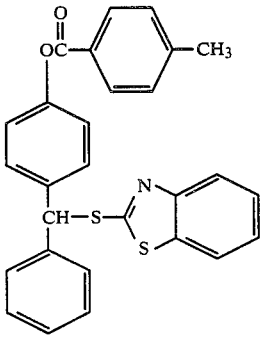
-continued
(51)
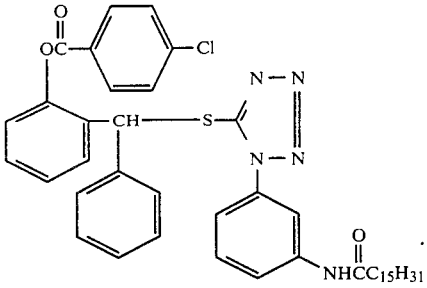
(52)
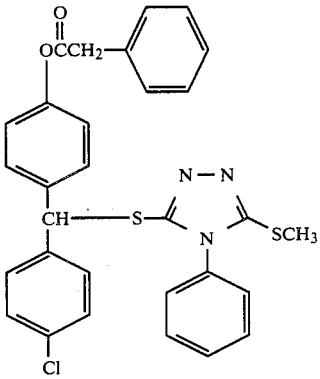
(53)
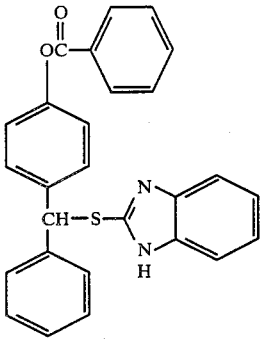
(54)
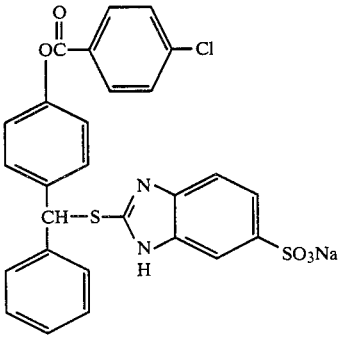

-continued
(55)
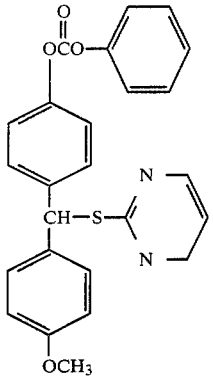
(56)
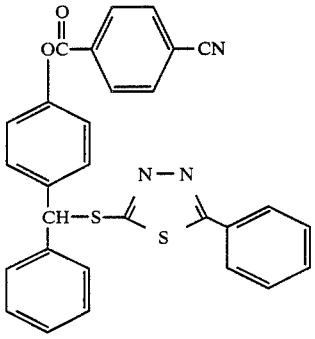
(57)
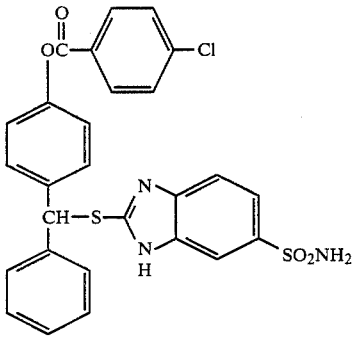
(58)
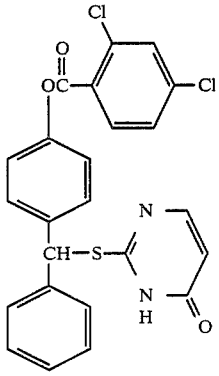
-continued
(59)
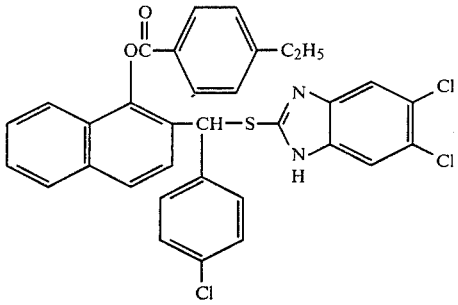
(60)
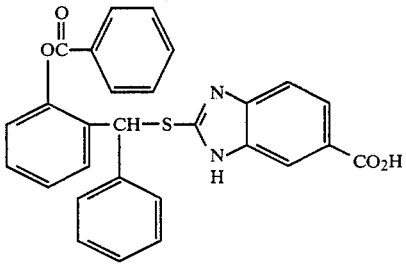
(61)
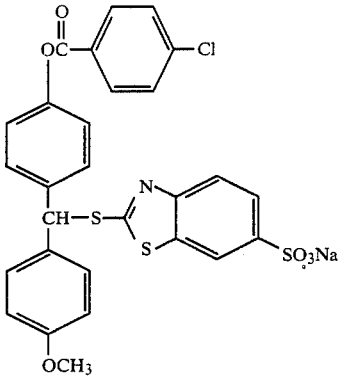
(62)
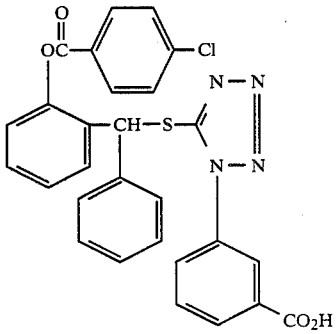

-continued
(63)
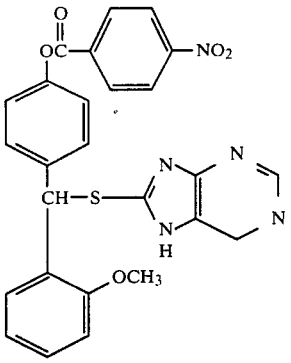
(64)
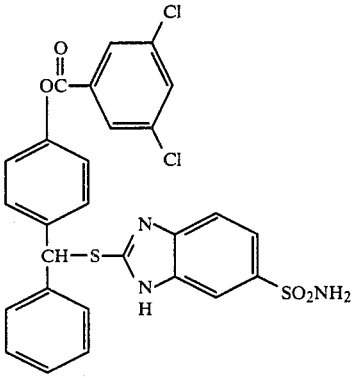
(65)
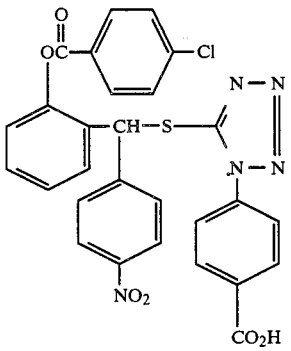
(66)
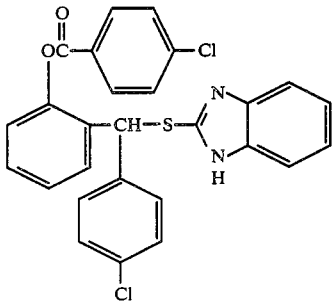
-continued
(67)
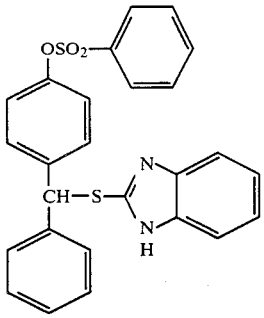
(68)
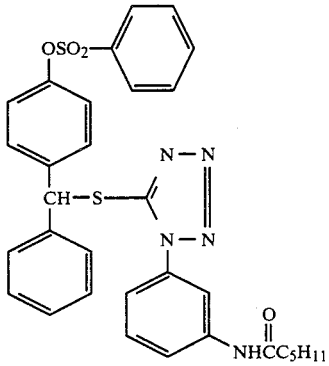
(69)
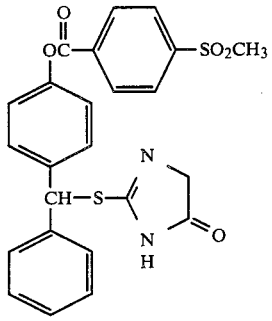
(70)
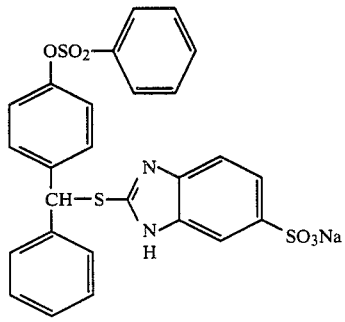

-continued
(71)
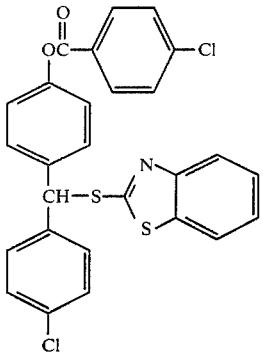
(72)
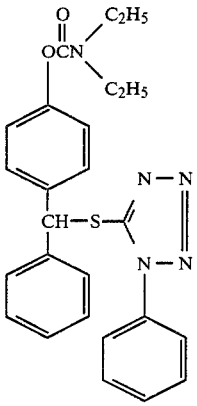
(73)
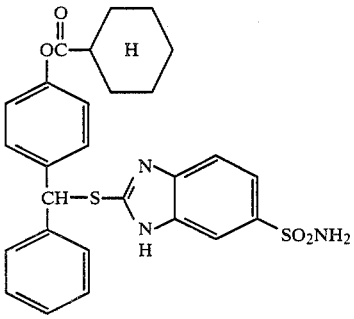
(74)
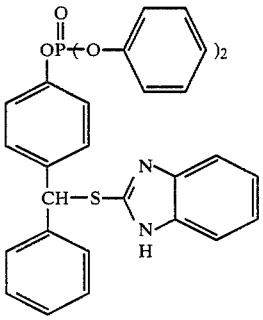
-continued
(75)
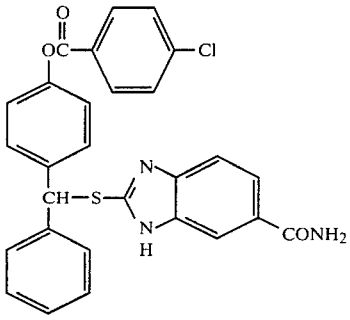
(76)
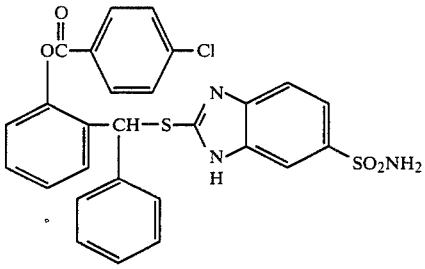
(77)
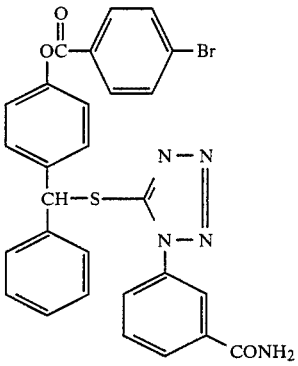
(78)
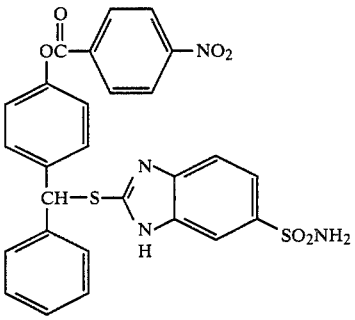
(79)
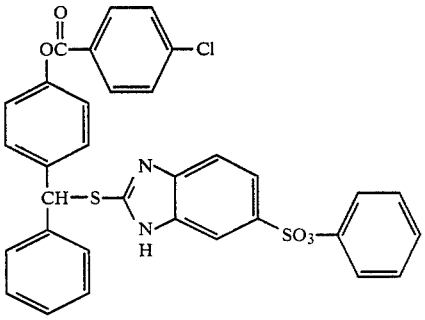

-continued
(80)
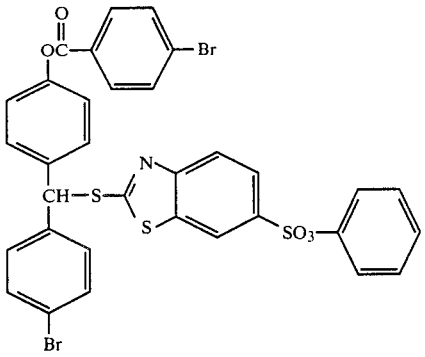
(81)
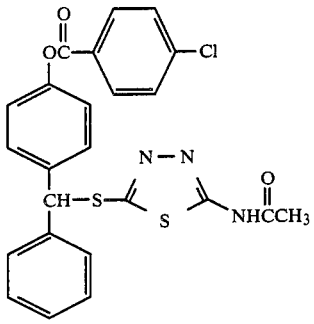
(82)
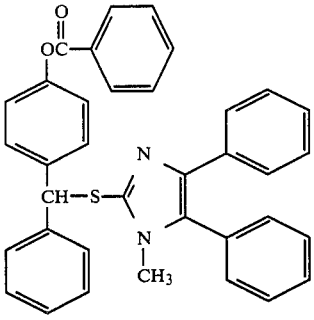
(83)
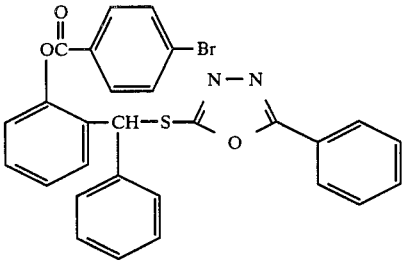
(84)
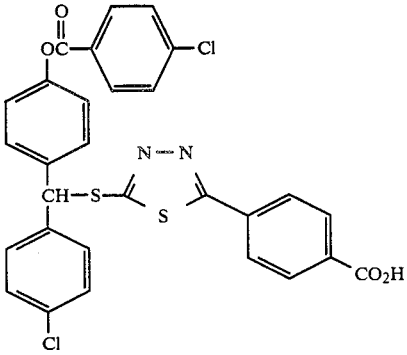
-continued
(85)
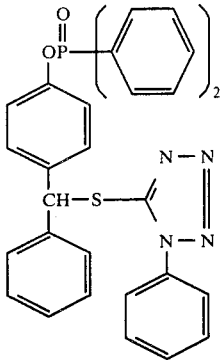
(86)
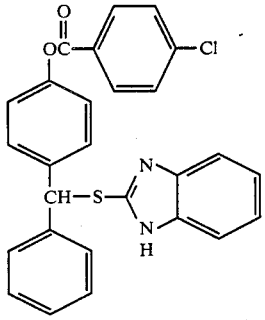
(87)
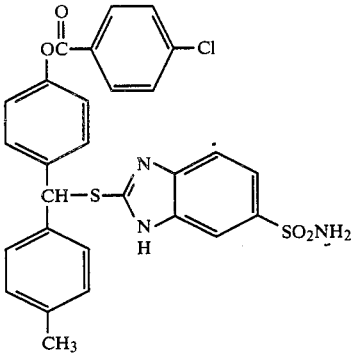
(88)
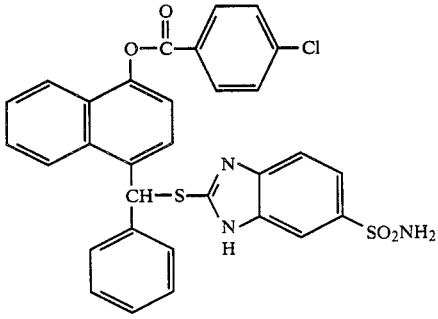

-continued
(89)
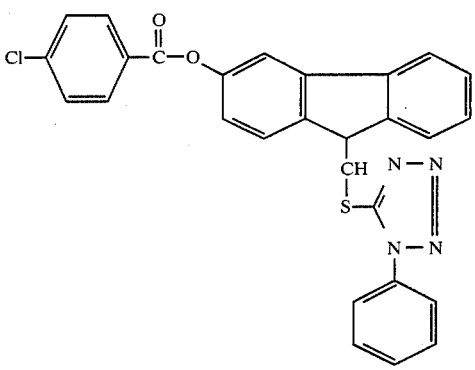
(90)
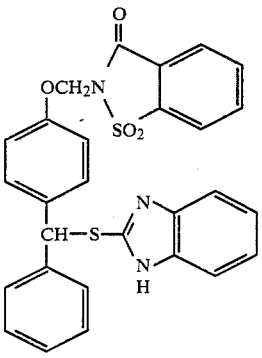
(91)
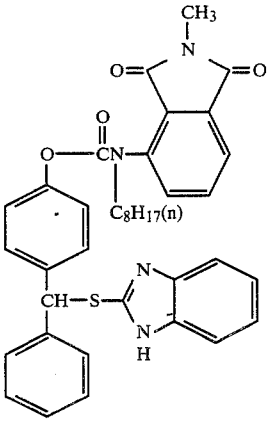
(92)
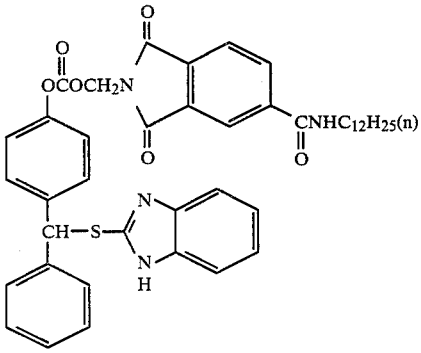
-continued
(93)
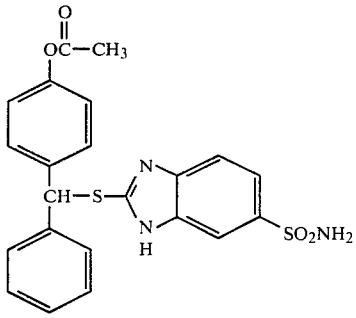
(94)
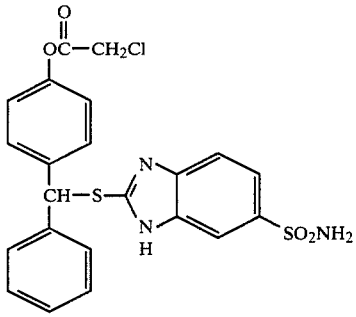
(95)
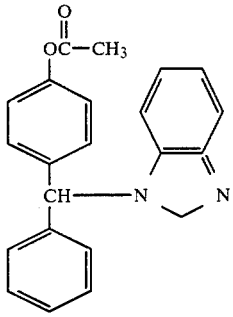
(96)
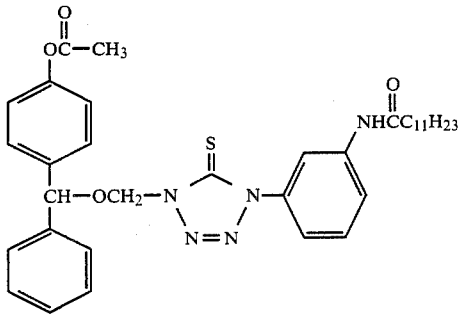
(97)
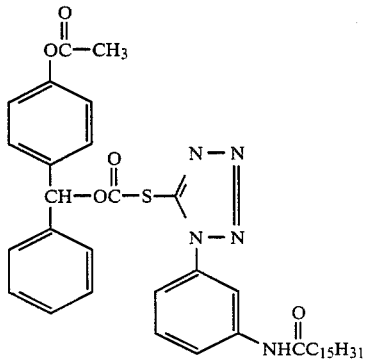

-continued (98)

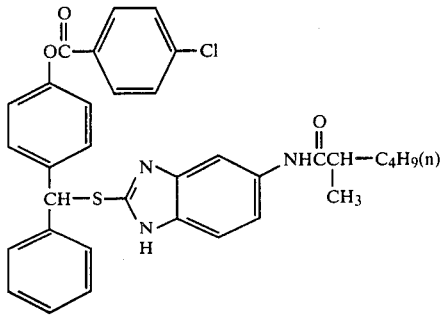

(99)

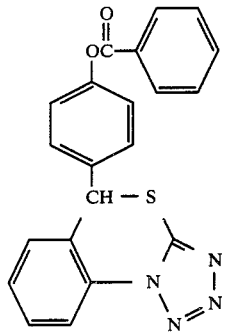

Methods for syntheses of the compounds according to the present invention will be illustrated below.

The compound represented by general formula (I) wherein X represents an atomic group necessary to complete a benzene ring and Q represents a hydrogen atom according to the present invention can be synthesized using ortho- or para-cresol as a starting material in the following reaction route.

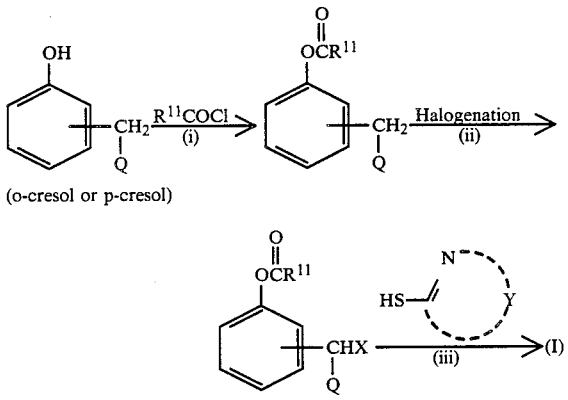

wherein X represents a halogen atom, and $R^{11}$ and Y each has the same meaning as defined above.

When $R^{11}SO_2Cl$ or

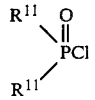

is used in place of $R^{11}COCl$ in step (i), the compound wherein —R represents the group of (B) or (C) can be also synthesized, respectively.

In the condensation reaction in step (i), it is desirable to use a base such as pyridine, triethylamine, dimethylaminopyridine, etc., as an acid removing agent.

The halogenation of the side chain in step (ii) is carried out using chlorine, sulfuryl chloride, bromine, N-chlorosuccinimide, N-bromosuccinimide, etc. In this step, it is preferred to use a radical initiator such as benzoyl peroxide (BPO), azobisisobutyronitrile (AIBN), etc., and light irradiation is also effective in many cases.

It is preferred to use an organic base such as triethylamine, etc., or an inorganic base such as potassium carbonate, etc., in the condensation reaction of step (iii). Further, when a sodium salt of thiol which has been prepared previously is used, the reaction proceeds smoothly.

Specific synthesis examples of the compounds according to the present invention are set forth below.

SYNTHESIS EXAMPLE 1

Synthesis of Compound (11)

Synthesis of p-Cresol Ester of p-Chlorobenzoic Acid 400 ml of an acetonitrile solution containing 43.2 g (0.4 mol) of p-cresol and 58.6 ml (0.42 mol) of triethylamine was cooled below 10° C. and, while maintaining the temperature, 73.5 g (0.42 mol) of p-chlorobenzoyl chloride was dropwise added thereto. After the completion of the dropwise addition, the mixture was stirred at room temperature for 1 hour and the reaction solution was poured into 2 liters of water. The crystals thus precipitated were collected by filtration, washed with water and recrystallized from methanol to obtain 88.6 g (0.36 mol) of the desired compound.

Synthesis of p-Bromomethylphenyl Ester of p-Chlorobenzoic Acid 800 ml of a carbon tetrachloride solution containing 84 g (0.34 mol) of p-cresol ester of p-chlorobenzoic acid obtained above, 50 g (0.28 mol) of N-bromosuccinimide and a small amount of benzoyl peroxide as a radical initiator was refluxed for 1 hour while irradiating the light. After completion of the reaction, the crystals of succinimide thus deposited were removed by filtration while it was still hot and the filtrate was concentrated under a reduced pressure. The residue was dissolved in ethyl acetate and washed with water. The ethyl acetate layer separated was dried with sodium sulfate and concentrated under a reduced pressure. The residue was recrystallized from a solvent mixture of n-hexane and ethyl acetate (2:1 in volume ratio) to obtain 63.2 g (0.194 mol) of the desired compound.

Synthesis of Compound (11)

100 ml of a methanol solution containing 31.5 g (0.21 mol) of 2-mercaptobenzimidazole and 40.5 g (0.21 mol) of a 28% methanol solution of sodium methylate was evaporated to dryness under a reduced pressure to prepare the sodium salt of 2-mercaptobenzimidazole.

To this was added 700 ml of an acetone solution containing 68.9 g (0.21 mol) of p-bromomethylphenyl ester of p-chlorobenzoic acid obtained above and the mixture was refluxed for 1 hour. After completion of the reaction, the reaction solution was cooled with ice, and the crystals thus deposited was collected by filtration, washed with warm water to remove the inorganic salt and then crystallized from isopropyl alcohol to obtain 56.9 g (0.144 mol) of the desired compound. Melting Point: 184° to 186° C.

SYNTHESIS EXAMPLE 2

Synthesis of Compound (7)

p-Cresol ester of benzoic acid was obtained by condensation of p-cresol and benzoyl chloride in the same manner as described in Synthesis Example 1.

100 ml of a carbon tetrachloride solution containing 10.6 g (0.05 mol) of the ester described above, 8.9 g (0.05 mol) of N-bromosuccinimide and a small amount of benzoyl peroxide as a radical initiator was refluxed for 1 hour while irradiating with light. After completion of the reaction, the crystals of succinimide thus deposited were removed by filtration while it was still hot and the filtrate was concentrated under a reduced pressure. By an NMR spectrum of the residue it was found that the residue was a mixture of three kinds of compounds described below and that the content of the desired monobromo compound (II) was about 77%.

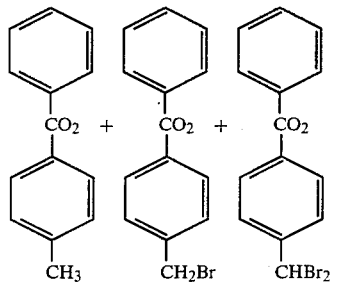

(I) (II) (III)

| Compound | Chemical Shift ($CDCl_3/Si(CH_3)_4$) |
|---|---|
| (I) | $\delta(CH_3) = 2.37$ |
| (II) | $\delta(CH_2Br) = 4.50$ |
| (III) | $\delta(CHBr_2) = 6.68$ |

Using 7.5 g (0.05 mol) of 2-mercaptobenzimidazole and 9.65 g (0.05 mol) of a 28% methanol solution of sodium methylate, the sodium salt was prepared in the same manner as described in Synthesis Example 1. To the solution of the sodium salt was added 80 ml of an acetone solution of the above described mixture and the mixture was refluxed for 1 hour. After completion of the reaction, the inorganic salt deposited was removed by filtration while it was still hot and the filtrate was cooled with ice. The crystals thus deposited were collected by filtration and washed with acetone to obtain 6.2 g (0.017 mol) of Compound (7). Melting Point: 178° to 180° C.

SYNTHESIS EXAMPLE 3

Synthesis of Compound (20)

Synthesis of o-Cresol Ester of p-Chlorobenzoic Acid 800 ml of an acetonitrile solution containing 64.8 g (0.6 mol) of o-cresol and 87 ml (0.62 mol) of triethylamine was cooled below 10° C. and, while maintaining the temperature, 108.6 g (0.62 mol) of p-chlorobenzoyl chloride was added dropwise thereto. After completion of the dropwise addition, the mixture was stirred at room temperature for 1 hour. Then, the mixture was poured into water, the solid thus deposited was extracted with ethyl acetate and separated. The ethyl acetate layer was dried with sodium sulfate and concentrated under a reduced pressure. To the residue was added n-hexane and the solution was cooled with ice. The crystals thus deposited were collected by filtration and washed with n-hexane to obtain 122 g (0.495 mol) of the desired compound.

Synthesis of Compound (20)

1 liter of a carbon tetrachloride solution containing 120 g (0.487 mol) of the ester described above, 69.5 g (0.39 mol) of N-bromosuccinimide and a small amount of succinimide as a radical initiator was refluxed for 1 hour while irradiating with light. After completion of the reaction, the crystals of succinimide thus deposited were removed by filtration and the filtrate was concentrated under a reduced pressure. By an NMR spectrum and thin layer chromatography of the oil thus obtained it was found that the oil is a mixture of the p-methyl compound of the starting material and the desired p-bromomethyl compound.

To the above described mixture were added 57 g (0.38 mol) of 2-mercaptobenzimidazole, 52.5 g (0.38 mol) of anhydrous potassium carbonate and 700 ml of acetone, and the mixture was refluxed for 1 hour. After completion of the reaction, the mixture was cooled to room temperature and the compound thus deposited was collected by filtration. The crystals obtained were added to 500 ml of water, extracted with chloroform and separated. The chloroform layer was dried with sodium sulfate and concentrated under a reduced pressure. The residue was recrystallized from a solvent mixture of isopropyl alcohol and n-hexane (5:1 in volume ratio) to obtain 79.3 g (0.201 mol) of Compound (20). Melting Point: 137° to 138° C.

SYNTHESIS EXAMPLE 4

Synthesis of Compound (57)

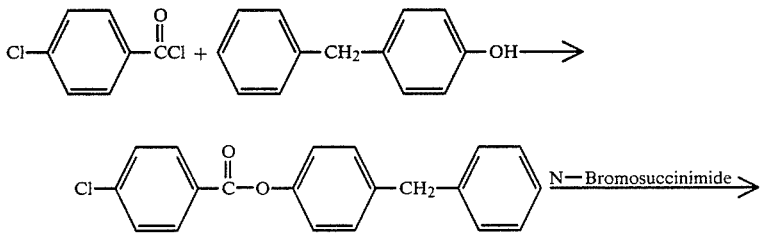

(57)-a

-continued

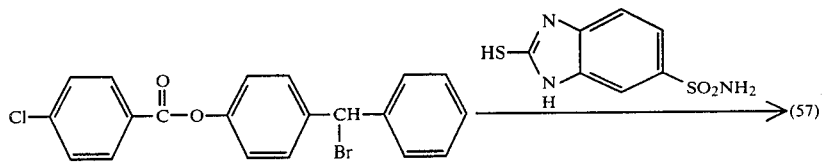

(57)-b

Synthesis of p-Benzylphenol Ester of p-Chlorobenzoic Acid ((57)-a)

200 ml of an acetonitrile solution containing 27.2 g (0.2 mol) of p-benzylphenol and 29.3 ml (0.21 mol) of triethylamine was cooled below 10° C. and, while maintaining the temperature, 36.7 g (0.21 mol) of p-chlorobenzoyl chloride was dropwise added thereto. After completion of the dropwise addition, the mixture was stirred at room temperature for 30 minutes. Then, the mixture was poured into water, the solid thus deposited was extracted with ethyl acetate and separated. The ethyl acetate layer was dried with sodium sulfate and concentrated under a reduced pressure. To the residue was added 300 ml of n-hexane. The crystals thus deposited were collected by filtration to obtain 47.8 g (0.148 mol) of Compound (57)-a. Yield: 74%.

Synthesis of (57)-b 300 ml of a carbon tetrachloride solution containing 39 g (0.12 mol) of Compound (57)-a, 21 g (0.118 mol) of N-bromosuccinimide and a small amount of benzoyl peroxide as a radical initiator was refluxed for 1 hour while irradiating with light. After completion of the reaction, the crystals of succinimide thus deposited were removed by filtration while it was still hot and the filtrate was cooled at 18° C. The crystals thus deposited were collected by filtration and washed with carbon tetrachloride to obtain 35.5 g (0.0884 mol) of Compound (54)-b. Yield: 74%.

Synthesis of Compound (57)

160 ml of an acetone solution of 16 g (0.04 mol) of Compound (57)-b, 8.2 g (0.036 mol) of 2-mercaptobenzimidazole-5-sulfonamide and 5.5 g (0.04 mol) of anhydrous potassium carbonate was refluxed for 2 hours. After completion of the reaction, the mixture was cooled with water and the thus obtained precipitates were collected by filtration. The residue was washed with water to remove the inorganic salts to obtain 12.5 g (0.0227 mol) of Compound (57). Melting Point: 179° to 181° C. Yield: 63%.

The amount of the compound according to the present invention varies depending upon the specific compound used and the system in which it is used, but it is generally not more than 50% by weight, preferably not more than about 30% by weight, based on the total weight of the coating layer. The optimum amount of the compound used greatly depends on the structure of development inhibitor (II) released. Among the above described development inhibitors (II), there are included compounds which accelerate development when an amount thereof is small and exhibit the development inhibiting function as an increase in an amount thereof is employed. Therefore, it is particularly advantageous to employ compound (I) according to the present invention which releases compound (II), because development is accelerated at the initial step and is restrained at the latter step.

The compound according to the present invention can be incorporated into a binder by dissolving it in a water-soluble organic solvent (such as methanol, ethanol, acetone, dimethylformamide, etc.) or a mixture of the organic solvent(s) and water.

The compound according to the present invention which is hydrophobic can also be incorporated in the form of fine particles into a binder using an oil protected method.

The compounds according to the present invention can be used either singly or in combination of two or more thereof. Further, it is possible to use the compound(s) according to the present invention together with development stopping agents or development stopping techniques other than the present invention. Such develoment stopping agents or development stopping techniques include a method utilizing heat decomposition of a aldoxime ester as described in U.S. patent application Ser. Nos. 672,643 (filed on Nov. 19, 1984) and 711,885 (filed on Mar. 14, 1985), a method utilizing Lossen rearrangement as described in U.S. patent application Ser. No. 727,718 (filed on Apr. 26, 1985), a method using a carboxylic acid ester as described in U.S. patent application Ser. No. 727,978 (filed on Apr. 26, 1985), etc.

The compound according to the present invention can be incorporated into a light-sensitive layer or an image receiving layer. The term "light-sensitive layer" used herein means a light-sensitive element or a light-sensitive photographic layer and means integrated colloid layers which contain at least one silver halide emulsion layer and which may contain an intermediate layer or a protective layer, etc., but does not mean a light-insensitive back layer which may be present on the opposite side of a support. The term "image receiving layer" used herein means an image receiving element of a dye fixing material in a broad sense. The image receiving layer can be positioned either on the same support as the light-sensitive layer or a different support therefrom.

When the compound according to the present invention which is hydrophobic is dispersed according to a method known as an oil protected method to prepare an oil-in-water type dispersion and then incorporated into a light-sensitive layer or an image receiving layer, a heat developable light-sensitive material having good preservability is obtained.

Besides using silver as an image forming substance, the present invention can employ a wide variety of image forming substances according to various methods as desired.

Such image forming substances can include couplers which form color images by coupling with oxidants of developers used in the widely known liquid development processing. Suitable examples of magenta couplers include 5-pyrazolone couplers, pyrazolobenzimidazole couplers, cyanoacetylcumarone couplers and open chain acylacetonitrile couplers. Suitable examples of yellow couplers include acylacetamide couplers (e.g., benzoylacetoanilides and pivaloylacetoanilides). Suitable examples of cyan couplers include naphthol couplers and phenol couplers. Preferably these couplers should be rendered nondiffusible by a hydrophobic group functioning as a ballast group, or should be polymerized. These couplers may be either two-equivalent or four-equivalent to silver ion. Colored couplers having a color correction effect, or couplers capable of releasing a development inhibitor upon development (so-called DIR couplers) may be included.

Another example of image-forming substances is dyes that form positive dye images using a light-sensitive silver dye bleach process. Specific examples of such dyes include those described in *Research Disclosure,* pp. 30–32 (RD-14433) (April 1976), *Research Disclosure,* pp. 14–15 (RD-15227) (December 1976), and U.S. Pat. No. 4,235,957, and leuco dyes described in U.S. Pat. No. 3,985,565 and 4,022,617.

In addition, dyes into which nitrogen-containing heterocyclic groups are introduced, as described in *Research Disclosure,* pp. 54–58 (RD-16966) (May, 1978), can be employed as image-forming substance.

Further, dye-providing substances capable of releasing mobile dyes by a coupling reaction with reducing agents oxidized by the redox reaction with silver halides or organic silver salts under high temperatures, as described in European Pat. No. 79,056, German Pat. No. 3,217,853, and European Pat. No. 67,455, and dye-providing substances of the kind which undergo a redox reaction with silver halides or organic silver salts under high temperatures to release mobile dyes, as described in European Pat. No. 76,492, German Pat. No. 3,215,484, European Pat. No. 66,282, and Japanese Patent Application (OPI) Nos. 15445/84 and 152400/84, can be employed.

Dye-providing substances which can be employed in the above-described methods are described in detail below.

Dye-providing substances which are useful in the present invention are represented by the following formula (I):

$$D—Y \qquad (I)$$

wherein D represents a dye moiety (including a dye precursor) moiety), and Y represents a substrate having the function of changing the diffusibility of the dye-providing substance of formula (I) through a redox reaction caused in the heat development step.

The expression "changing the diffusibility" is intended to include two cases: (1) the compound (I) is nondiffusible by nature, and it is converted to a diffusible compound or releases a diffusible dye, and (2) an essentially diffusible compound (I) is changed into a nondiffusible form. Such changes in diffusibility result from either oxidation or reduction of Y. Which reaction Y undergoes depends on the nature of Y, and Y can be selected appropriately according to the reaction desired.

In the case where the diffusibility is changed by oxidation of Y, examples of Y include "dye-releasing redox" substrates such as p-sulfonamidonaphthols and p-sulfonamidophenols, examples of which are described in Japanese Patent Application (OPI) Nos. 33826/73 and 50736/78, and European Pat. No. 76,492; o-sulfonamidophenols and o-sulfonamidonaphthols, examples of which are described in Japanese Patent Application (OPI) Nos. 113624/76, 126542/81, 16130/81, 16131/81, 4043/82 and 650/82, U.S. Pat. No. 4,053,312, and European Pat. No. 76,492; hydroxysulfonamidoheterocyclic compounds (as described in Japanese Patent Application (OPI) No. 104343/76, and European Pat. No. 76,492); and 3-sulfonamidoindoles (as described in Japanese Patent Application (OPI) Nos. 104343/76, 46730/78, 130122/79 and 85055/82, and European Pat. No. 76,492).

Other examples of Y in which the diffusibility is changed by oxidation of Y include intramolecular assist type substrates described in Japanese Patent Application (OPI) Nos. 20735/82 and 65839/84, which release dyes by an intramolecular nucleophilic attack after Y has been oxidized.

Additional examples of Y in which Y is oxidized include substrates which substantially lose dye-releasing capability when oxidized, although they can release dyes by an intramolecular ring-closure reaction under basic conditions, such as the substrates described in Japanese Patent Application (OPI) No. 63681/76. As a modification of such substrates, substrates which can release dyes when an iso-oxazolone ring changes its manner of bonding of a ring by the attack of a nucleophilic agent thereon are also useful. Specific examples of such modified substrates are described in Japanese Patent Application (OPI) Nos. 111628/74 and 4819/77.

Further examples of Y include substrates of the kind which lose substantially their dye-releasing ability by being oxidized through the dye moiety splits off by dissociation of an acidic proton under basic conditions, described in Japanese Patent Application (OPI) Nos. 69033/78 and 130927/79.

On the other hand, examples of Y in which the diffusibility is changed by reduction of Y, include nitro compounds described in Japanese Patent Application (OPI) No. 110827/78, and quinone compounds described in Japanese Patent Application (OPI) No. 110827/78, and U.S. Pat. Nos. 4,356,249 and 4,358,525. These substrates are reduced with a reducing agent (called an electron donor) that is not consumed in the heat development step. As the result of the reduction, the substrates produce nucleophilic groups, and release dyes by intramolecular attack of the resulting nucleophilic groups. As a modification of these substrates, those of quinone type, in which a dye moiety splits off through dissociation of an acidic proton of the reduction product, are also useful. (Specific examples of such modified substrates are described in Japanese Patent Application (OPI) Nos. 130927/79 and 164342/81). When substrates causing changes in diffusibility by reduction are employed, it is essential to use a proper reducing agent (electron donor) for mediation between a silver salt oxidizer and a dye-providing substance. Specific examples of suitable reducing agents for this purpose are described in the foregoing publications. In addition, substrates which contain an electron donor in their molecules ("LDA compounds") can be used to advantage.

Still other examples of image-forming materials include compounds having a dye moiety which change their mobilities as the result of a redox reaction with silver halides or organic silver salts under high temperatures, which are described in Japanese Patent Application (OPI) No. 165054/84, and materials capable of releasing mobile dyes by reaction with silver ions present in sensitive materials, such as those described in Japanese Patent Application (OPI) No. 180548/84.

Many of the above-described materials form an imagewise distribution of mobile dyes in sensitive materials in proportion to exposure to light. Methods for transferring these image dyes into a dye-fixing material (i.e., "diffusion transfer") are described in the above patent documents, Japanese Patent Application (OPI) Nos. 168439/84 and 182447/84.

The dye-providing substance used in the present invention can be introduced into a layer of the photosensitive material by known methods such as a method as described in U.S. Pat. No. 2,322,027. In this case, an organic solvent having a high boiling point or an organic solvent having a low boiling point as described below can be used. For example, the dye-providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye-providing substance is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agents such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the photosensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, A silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the photosensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium·trichloroacetate as described in U.S. Pat. No. 3,301,678, a bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a photosensitive material and/or a dye fixing material. In the case of incorporating them in a photosensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium ammonia, $MeNH_2$ (Me represents $CH_2$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

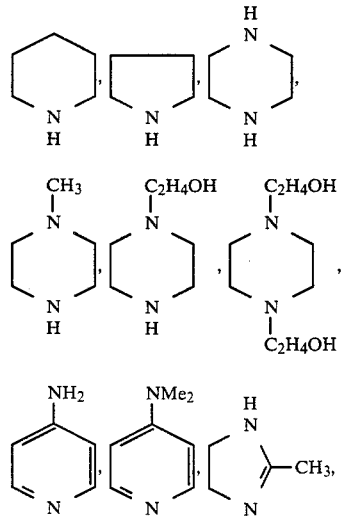

-continued

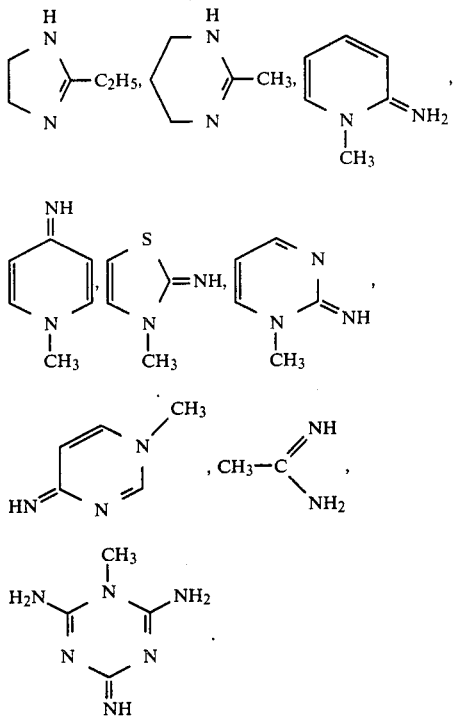

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc. are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the photosensitive material, and, preferably a range of from 0.01% by weight of 40% by weight.

The above-described bases or base precursors can be used not only for the acceleration of dye release but also for other purposes such as the control of a pH value.

The above-described various ingredients to constitute a heat developable photosensitive material can be arranged in arbitrary positions, if desired. For instance, one or more of the ingredients can be incorporated in one or more of constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat developable photosensitive material is exposed to light, the resulting laten image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxohol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly of the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,697,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the photosensitive material and the dye-fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the heat developable photosensitive material and the dye-fixing material of the present invention, the photographic emulsion layer and other binder layers may contain inorganic or organic hardeners. It is possible to use chromium slats (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloride acid, etc.), etc., which are used individually or as a combination thereof.

The transfer of dyes from the light-sensitive layer to the dye-fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the photosensitive material or the dye-fixing material, it is not necessary to supply the transfer assistant from the outside. In this case, the above described dye transfer assistant may be incorporated into the material in the form of water of crystalization or microcapsules or as a precursor which releases a solvent at a high temperature.

More preferred process is a process wherein a hydrophilic thermal solvent which is solid at an ambient temperature and melts at a high temperature is incorporated into the photosensitive material or the dye-fixing material. The hydrophilic thermal solvent can be incorporated either into any of the photosensitive material and the dye-fixing material or into both of them. Although the solvent can be incorporated into any of the emulsion layer, the intermediate layer; the protective layer and the dye-fixing layer, it is preferred to incorporate it into the dye-fixing layer and/or adjacent layers thereto.

Examples of the hydrophilic thermal sovlents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mrodants and so on, are those described in U.S. Pat. Nos. 4,500,626, 4,478,927, 4,463,079 and Japanese Patent Application No. 28928/83 (corresponding to U.S. patent application Ser. No. 582,655 filed on Feb. 23, 1984) and U.S. Pat. No. 4,503,137. Methods for the exposure and so on cited in the above described patents can be employed in the present invention also.

According to the present invention, the amount of alkali agent to be used can be reduced as well as the amount of gelatin used can be reduced. Thus, preservability of the light-sensitive material is also improved.

The present invention will be explained in greater detail with reference to the following examples, but the present invention should not be construed as being limited thereto. Unless otherwise indicated, all parts, percents, ratios and the like are by weight.

EXAMPLE 1

A method of preparing a silver iodobromide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above prepared solution over 10 minutes. Then, a solution of 3.3 g of potassium iodide (KI) dissolved in 100 ml of water was added over 2 minutes. The thus prepared silver iodobromide emulsion was precipitated and freed of excess salts. it was then adjusted to pH 6.0, whereby 400 g of a silver iodobromide emulsion was obtained.

A method of preparing a silver benzotriazole emulsion is described in the following.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over 2 minutes. The thus prepared silver benzotriazole emulsion was precipitated and freed of excess salts. It was then adjusted to pH 6.0, whereby 400 g of a silver benzotriazole emulsion was obtained.

A method of preparing a gelatin dispersion of a dye providing substance (hereinafter it has the same meaning as an image forming substance described above) is described in the following.

A mixture of 5 g of Dye Providing Substance (1) described below, 0.5 g of succinic acid 2-ethylhexyl ester sulfonic acid sodium salt as a surface active agent, 5 g of tricresyl phosphate (TCP) and 30 ml of ethyl acetate was dissolved by heating at about 60° C. This solution was mixed with 100 g of a 10% aqueous solution of gelatin and the mixture was dispersed by means of a homogenizer at 10,000 rpm for 10 minutes. The dispersion thus obtained was designated a dispersion of dye providing substance.

Dye Providing Substance (1)

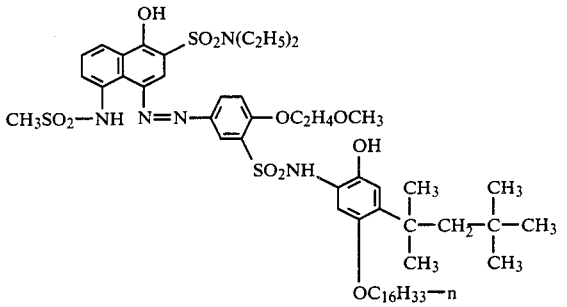

A method of preparing a gelatin dispersion of the compound according to the present invention is described in the following.

3 g of Compound (20) according to the present invention was added to 100 g of a 1% aqueous solution of gelatin and the mixture was ground in a mill using 100 g of glass beads having an average diameter of about 0.6 mm for 10 minutes. By removing the glass beads by filtration, a gelatin dispersion of the compound according to the present invention was obtained.

In the following, methods of preparing Light-Sensitive Materials A and B are described.

| Light-Sensitive Material A | |
|---|---|
| (a) Silver iodobromide emulsion | 20 g |
| (b) Silver benzotriazole emulsion | 10 g |
| (c) Dispersion of Dye Providing Substance (1) | 33 g |
| (d) 5% Aqueous solution of a compound having the following formula: | 10 ml |

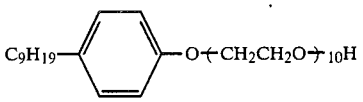

| | |
|---|---|
| (e) 10% Aqueous solution of a compound having the following formula: $H_2NSO_2N(CH_3)_2$ | 4 ml |
| (f) Solution containing 1.6 g of guanidine trichloroacetate (a base precursor) dissolved in 16 ml of ethanol | |
| (g) Gelatin dispersion of Compound (20) according to the present invention | 5 ml |
| (h) Water | 5 ml |

The above components (a) to (h) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material A was prepared.

| | |
|---|---|
| (a) 10% Aqueous solution of gelatin | 30 ml |
| (b) Water | 70 ml |
| Light-Sensitive Material B | |
| (a) Silver iodobromide emulsion | 20 g |
| (b) Silver benzotriazole emulsion | 10 g |
| (c) Dispersion of Dye Providing Substance (1) | 33 g |
| (d) 5% Aqueous solution of a compound having the following formula: | 10 ml |

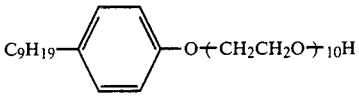

| | |
|---|---|
| (e) 10% Aqueous solution of a compound having the following formula: $H_2NSO_2N(CH_3)_2$ | 4 ml |
| (f) Solution containing 1.6 g of guanidine trichloroacetate (a base precursor) dissolved in 16 ml of ethanol | |
| (g) Water | 10 ml |

The above components (a) to (g) were mixed and dissolved by heating and the mixture was coated on a polyethylene terephthalate film having a thickness of 180 μm at a wet layer thickness of 33 μm and dried. On the thus formed layer, a protective layer was provided in the same manner as described for Light-Sensitive Material A.

A method of preparing an image receiving material having an image receiving layer is described in the following.

10 g of poly(methyl acrylate-co-N,N,N-trimethyl-N-vinylbenzylammonium chloride) (molar ratio of methyl acrylate to vinylbenzylammonium chloride was 1:1) was dissolved in 200 ml of water and then uniformly mixed with 100 g of a 10% aqueous solution of lime processed gelatin. The resulting mixture was uniformly coated at a wet layer thickness of 90 μm on a paper support laminated with polyethylene with titanium dioxide dispersed therein and dried. The thus prepared material was used as an image receiving material.

Light-Sensitive Materials A and B described above were each imagewise exposed for 10 seconds at 2,000 lux using a tungsten lamp and then uniformly heated for 30 seconds or 40 seconds or a heat block heated at 140° C.

The image receiving material was soaked in water and then superimposed on each of the above heated Light-Sensitive Materials A and B in such a manner that their coated layers were in contact with each other.

After heating for 6 seconds on a heated block maintained at 80° C., the image receiving material was separated fromthe light-sensitive material, whereupon a negative magenta dye image was obtained in the image receiving material.

Negative image density was measured by means of a Macbeth reflective densitometer (RD-519). The results thus obtained are shown in Table 1.

TABLE 1

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| A (Present Invention) | 2.14 | 0.14 | 2.18 | 0.27 |
| B (Comparison) | 2.15 | 0.15 | 2.20 | 0.32 |

It is apparent from the results shown in Table 1 that the increases in the maximum density and minimum density are small even when the developing time is extended 10 seconds due to the use of the compound according to the present invention. On the contrary, in the comparative sample which did not contain the compound according to the present invention, a remarkable increase of fog was observed. Therefore, it can be understood that the compound according to the present invention has a large effect on stopping development.

EXAMPLE 2

In this example, cases where a silver benzotriazole emulsion is not used are illustrated.

A method of preparing Light-Sensitive Materials C and D is described in the following.

| Light-Sensitive Material C | |
|---|---|
| (a) Light-Sensitive silver iodobromide emulsion (the same as described in Example 1) | 25 g |
| (b) Dispersion of Dye Providing Substance (1) (the same as described in Example 1) | 33 g |
| (c) 5% Aqueous solution of a compound having the following formula: 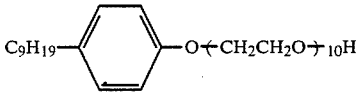 | 10 ml |
| (d) 10% Aqueous solution of a compound having the following formula: $H_2NSO_2N(CH_3)_2$ | 4 ml |
| (e) Solution containing 1.5 g of guanidine trichloroacetate dissolved in 15 ml of ethanol | |
| (f) Gelatin dispersion of Compound (20) according to the present invention (the same as described in example 1) | 5 ml |
| (g) Water | 5 ml |

The above components (a) to (g) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material C was prepared.

| | |
|---|---|
| (a) 10% Aqueous solution of gelatin | 30 ml |
| (b) Water | 70 ml |

-continued

| Light-Sensitive Material D | |
|---|---|
| (a) Light-sensitive silver iodobromide emulsion (the same as described in Example 1) | 25 g |
| (b) Dispersion of Dye Providing Substance (1) (the same as described in Example 1) | 33 g |
| (c) 5% Aqueous solution of a compound having the following formula: 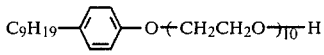 | 10 ml |
| (d) 10% Aqueous solution of a compound having the following formula: $H_2NSO_2N(CH_3)_2$ | 4 ml |
| (e) Solution containing 1.5 g of guanidine trichloroacetate dissolved in 15 ml of ethanol | |
| (f) Water | 10 ml |

The above components (a) to (f) were mixed and dissolved by heating and the mixture was coated on a polyethylene terephthalate film having a thickness of 180 μm at a wet layer thickness of 33 μm and dried. On the thus formed layer, the protective layer was provided in the same manner as described for Light-Sensitive Material C.

Light-Sensitive Materials C and D thus obtained were subjected to the same procedures as described in Example 1 and the results shown in Table 2 were obtained.

TABLE 2

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| C (Present Invention) | 1.98 | 0.18 | 2.12 | 0.21 |
| D (Comparison) | 2.00 | 0.20 | 2.18 | 0.37 |

As is apparent from the results shown in Table 2, a large effect on stopping development was obtained by using the compound according to the present invention.

EXAMPLE 3

In this example, cases where a base precursor is not used are illustrated.

A dispersion of dye providing substance was prepared in the same manner as described in Example 1 except using 5 g of Dye Providing Substance (2) described below in place of Dye Providing Substance (1).

Dye Providing Substance (2)

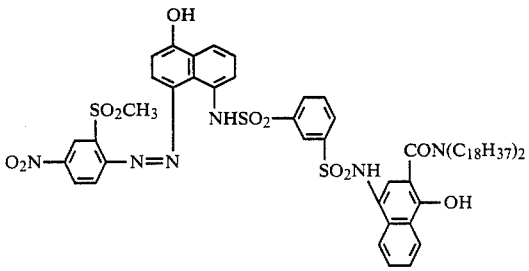

A method of preparing Light-Sensitive Materials E and F is described in the following.

| Light-Sensitive Material E | |
|---|---|
| (a) Silver iodobromide emulsion (the same as described in Example 1) | 20 g |
| (b) Silver benzotriazole emulsion (the same as described in Example 1) | 10 g |
| (c) Dispersion of Dye Providing Substance (2) | 33 g |
| (d) 5% Aqueous solution of a compound having the following formula: 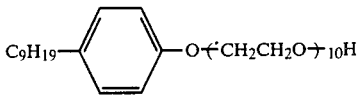 | 10 ml |
| (e) 10% Aqueous solution of a compound having the following formula: $H_2NSO_2N(CH_3)_2$ | 4 ml |
| (f) Gelatin dispersion of Compound (20) according to the present invention (the same as described in Example 1) | 5 ml |
| (g) Water | 20 ml |

The above components (a) to (g) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material E was prepared.

| | |
|---|---|
| (a) 10% Aqueous solution of gelatin | 30 ml |
| (b) Water | 70 ml |
| Light-Sensitive Material F | |
| (a) Silver iodobromide emulsion (the same as described in Example 1) | 20 g |
| (b) Silver benzotriazole emulsion (the same as described in Example 1) | 10 g |
| (c) Dispersion of Dye Providing Substance (2) | 33 g |
| (d) 5% Aqueous solution of a compound having the following formula: 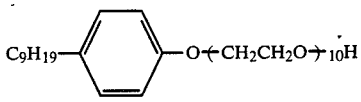 | 10 ml |
| (e) 10% Aqueous solution of a compound having the following formula: $H_2NSO_2N(CH_3)_2$ | 4 ml |
| (f) Water | 26 ml |

The above components (a) to (f) were mixed and dissolved by heating and the mixture was coated on a polyethylene terephthalate film having a thickness of 180 μm at a wet layer thickness of 33 μm and dried. On the thus-formed layer, a protective layer was provoded in the same manner as described in Light-Sensitive Material E.

Light-Sensitive Materials E and F thus obtained were each exposed imagewise for 10 seconds at 2,000 lux using a tungsten lamp and then uniformly heated for 30 seconds or 40 seconds on a heat block heated at 160° C.

The same image receiving material as described in Example 1 was soaked in water and then superimposed on each of the above-heated Light-Sensitive Materials E and F in such a manner that their coated layers were in contact with each other.

After heating for 6 seconds on a heat block maintained at 80° C., the image receiving material was separated from the light-sensitive material, whereupon a negative magenta color image was obtained in the image receiving material.

The negative image was measured for its density by means of a Macbeth reflective densitometer (RD-519). The results thus obtained are shown in Table 3.

TABLE 3

| Light-Sensitive Material | Heating at 160° C. for 30 Seconds | | Heating at 160° C. for 40 Seconds | |
|---|---|---|---|---|
| | Maximum Density | Minimum Density | Maximum Density | Minimum Density |
| E (Present Invention) | 1.40 | 0.24 | 1.48 | 0.27 |
| F (Comparison) | 1.42 | 0.25 | 1.60 | 0.80 |

From the results shown in Table 3 it can be understood that the compound according to the present invention has a large effect on stopping development even when a base precursor is not used.

EXAMPLE 4

Light-Sensitive Materials G to I were prepared in the same manner as described for Light-Sensitive Material A of Example 1 except using the compounds shown in Table 4 below in place of Compound (20), respectively, and subjected to the same procedures as described in Example 1. The results thus obtained are shown in Table 4.

TABLE 4

| Light-Sensitive Material | Compound | Heating at 140° C. for 30 Seconds | | Heating at 140° C. for 40 Seconds | |
|---|---|---|---|---|---|
| | | Maximum Density | Minimum Density | Maximum Density | Minimum Density |
| G (Present Invention) | (2) | 2.10 | 0.10 | 2.14 | 0.18 |
| H (Present Invention) | (11) | 2.15 | 0.15 | 2.19 | 0.22 |
| I (Present Invention) | (15) | 1.97 | 0.11 | 2.04 | 0.16 |
| B (Comparison, same as in Example 1) | None | 2.15 | 0.15 | 2.20 | 0.31 |

From the results shown in Table 3 it can be understood that the compounds according to the present invention exhibit excellent effects on stopping development.

EXAMPLE 5

Dispersions of dye providing substances were prepared in the same manner as described in Example 1 except using the dye providing substances shown in Table 5 below in place of Dye Providing Substance (1), respectively.

| | | |
|---|---|---|
| Dye Providing Substance (3) | 5 g | Dispersion (I) |
| Dye Providing Substance (5) | 7.5 g | Dispersion (II) |
| Dye Providing Substance (4) | 5 g | Dispersion (III) |

Light-Sensitive Materials M, O and Q were prepared in the same manner as described for Light-Sensitive Material A of Example 1 except using the dye providing substances as described above in place of Dye Providing Substance (1), respectively. Further, Light-Sensitive Materials N, P and R were prepared in the same manner as described for Light-Sensitive Material B of Example 1 except using the dye providing substances as described above in place of Dye Providing Substance (1), respectively. The light-sensitive materials thus obtained were subjected to the same procedures as described in Example 1 and the results shown in Table 5 were obtained.

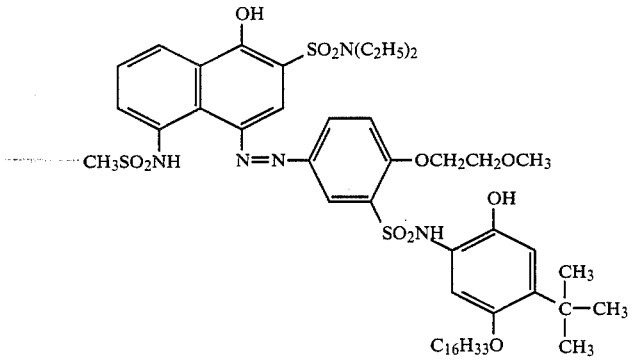

Dye Providing Substance (3)

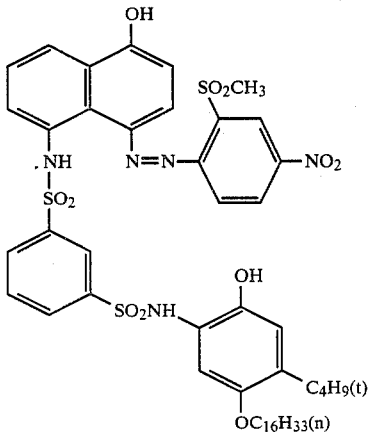

Dye Providing Substance (4)

-continued

Dye Providing Substance (5)

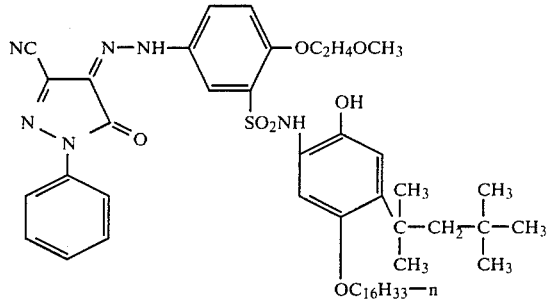

TABLE 5

| Light-Sensitive Material | Dispersion of Dye Providing Substance | Compound | Heating at 140° C. for 30 Seconds | | Heating at 140° C. for 40 Seconds | |
|---|---|---|---|---|---|---|
| | | | Maximum Density | Minimum Density | Maximum Density | Minimum Density |
| M (Present Invention) | Dispersion (I) (magenta) | (20) | 2.23 | 0.19 | 2.27 | 0.28 |
| N (Comparison) | Dispersion (I) (magenta) | None | 2.25 | 0.20 | 2.32 | 0.42 |
| O (Present Invention) | Dispersion (II) (yellow) | (20) | 1.92 | 0.18 | 2.00 | 0.32 |
| P (Comparison) | Dispersion (II) (yellow) | None | 1.95 | 0.22 | 2.02 | 0.46 |
| Q (Present Invention) | Dispersion (III) (cyan) | (20) | 2.22 | 0.18 | 2.29 | 0.24 |
| R (Comparison) | Dispersion (III) (cyan) | None | 2.30 | 0.20 | 2.34 | 0.38 |

From the results shown in Table 5 it can be understood that the compound according to the present invention exhibits excellent effects on stopping development.

EXAMPLE 6

In this example the base precursors as described below were used in place of guanidine trichloroacetate in Example 1, respectively.

Base Precursor I:

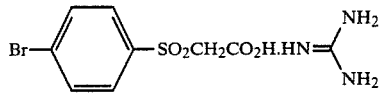

Base Precursor II:

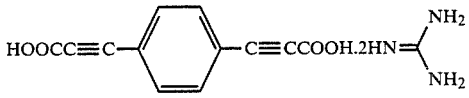

Light-Sensitive Material S:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: | 10 ml |

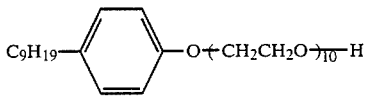

| | | |
|---|---|---|
| (e) | 10% Aqueous solution of a compound having the following formula: $H_2NSO_2N(CH_3)_2$ | 4 ml |
| (f) | 8% Water-methanol (1:1 by volume) | 32 ml |

-continued

| | | |
|---|---|---|
| | solution of Base Precursor I | |
| (g) | Gelatin dispersion of Compound (20) according to the present invention (the same as described in Example 1) | 5 ml |
| (h) | Water | 5 ml |

The above components (a) to (h) were mixed and dissolved by heating and the mixture was coated on a polyethylene terephthalate film having a thickness of 180 μm at a wet layer thickness of 38 μm and then dried. On the thus formed layer, a solution having the following composition was coated at a wet layer thickness of 30 μm and dried to form a protective layer, whereupon Light-Sensitive Material S was prepared.

| | | |
|---|---|---|
| (a) | 10% Aqueous solution of gelatin | 30 ml |
| (b) | Water | 70 ml |
| | Light-Sensitive Material T: | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: | 10 ml |

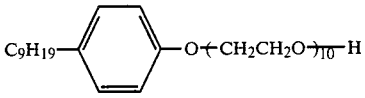

| | | |
|---|---|---|
| (e) | 10% Aqueous solution of a compound having the following formula: $H_2NSO_2N(CH_3)_2$ | 4 ml |
| (f) | 8% Water-methanol (1:1 by volume) solution of Base Precursor I | 32 ml |
| (g) | Water | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, a protective layer was provided in the same manner as described for Light-Sensitive Material S.

| | Light-Sensitive Material U: | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: | 10 ml |

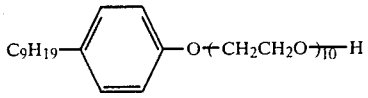

| | | |
|---|---|---|
| (e) | 10% Aqueous solution of a compound having the following formula: $H_2NSO_2N(CH_3)_2$ | 4 ml |
| (f) | 8% Water-methanol (1:1 by volume) of Base Precursor II | 32 ml |
| (g) | Gelatin dispersion of Compound (20) according to the present invention (the same as described in Example 1) | 5 ml |
| (h) | Water | 5 ml |

The above components (a) to (h) were mixed and dissolved by heating and the mixture was coated on a polyethylene terephthalate film having a thickness of 180 μm at a wet layer thickness of 38 μm and then dried. On the thus formed layer, a solution having the following composition was coated at a wet layer thickness of 30 μm and dried to form a protective layer, whereupon Light-Sensitive Material U was prepared.

| | | |
|---|---|---|
| (a) | 10% Aqueous solution of gelatin | 30 ml |
| (b) | Water | 70 ml |
| | Light-Sensitive Material V: | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: | 10 ml |

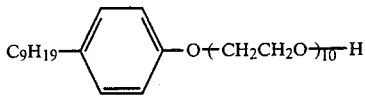

| | | |
|---|---|---|
| (e) | 10% Aqueous solution of a compound having the following formula: $H_2NSO_2N(CH_3)_2$ | 4 ml |
| (f) | 8% Water-methanol (1:1 by volume) solution of Base Precursor II | 32 ml |
| (g) | Water | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, a protective layer was provided in the same manner as described for Light-Sensitive Material U.

Light-Sensitive Materials S, T, U and V thus obtained were subjected to the same procedures as described in Example 1 and the results shown in Table 6 were obtained.

TABLE 6

| Light-Sensitive Material | Base Precursor | Compound | Heating at 140° C. for 30 Seconds | | Heating at 140° C. for 40 Seconds | |
|---|---|---|---|---|---|---|
| | | | Maximum Density | Minimum Density | Maximum Density | Minimum Density |
| S (Present Invention) | I | (20) | 1.72 | 0.11 | 1.80 | 0.19 |
| T (Comparison) | (I) | None | 1.80 | 0.12 | 1.92 | 0.29 |
| U (Present Invention) | (II) | (20) | 2.10 | 0.12 | 2.16 | 0.18 |

TABLE 6-continued

| Light-Sensitive Material | Base Precursor | Compound | Heating at 140° C. for 30 Seconds Maximum Density | Heating at 140° C. for 30 Seconds Minimum Density | Heating at 140° C. for 40 Seconds Maximum Density | Heating at 140° C. for 40 Seconds Minimum Density |
|---|---|---|---|---|---|---|
| V (Comparison) | (II) | None | 2.15 | 0.14 | 2.21 | 0.32 |

As is apparent from the results shown in Table 6, a large effect on stopping development was obtained by using the compound according to the present invention.

EXAMPLE 7

| Light-Sensitive Material W: | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: 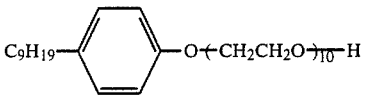 | 10 ml |
| (e) | 10% Aqueous solution of a compound having the following formula: $H_2NSO_2N(CH_3)_2$ | 4 ml |
| (f) | Solution containing 0.8 g of guanidine trichloroacetate (a base precursor) dissolved in 8 ml of ethanol | |
| (g) | Gelatin dispersion of Compound (20) according to the present invention (the same as described in Example 1) | 3 ml |
| (h) | Water | 15 ml |

The above components (a) to (h) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material W was prepared.

| | | |
|---|---|---|
| (a) | 10% Aqueous solution of gelatin | 30 ml |
| (b) | Water | 56 ml |
| (c) | Solution containing 0.9 g of guanidine trichloroacetate dissolved in 9 ml of ethanol | |
| (d) | Gelatin dispersion of Compound (20) according to the present invention (the same as described in Example 1) | 5 ml |
| | Light-Sensitive Material X: | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (1) (the same as described in Example 1) | 33 g |
| (d) | 5% Aqueous solution of a compound having the following formula: 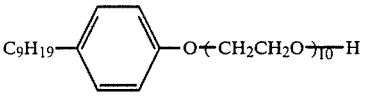 | 10 ml |

-continued

| | | |
|---|---|---|
| (e) | 10% Aqueous solution of a compound having the following formula: $H_2NSO_2N(CH_3)_2$ | 4 ml |
| (f) | Solution containing 0.8 g of guanidine trichloroacetate (a base precursor) dissolved in 8 ml of ethanol | |
| (g) | Water | 18 ml |

The above components (a) to (g) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material X was prepared.

| | | |
|---|---|---|
| (a) | 10% Aqueous solution of gelatin | 30 ml |
| (b) | Water | 61 ml |
| (c) | Solution containing 0.9 g of guanidine trichloroacetate dissolved in 9 ml of ethanol | |

Light-Sensitive Materials W and X thus obtained were subjected to the same procedures as described in Example 1 and the results shown in Table 7 were obtained.

TABLE 7

| Light-Sensitive Material | Heating at 140° C. for 30 Seconds Maximum Density | Heating at 140° C. for 30 Seconds Minimum Density | Heating at 140° C. for 40 Seconds Maximum Density | Heating at 140° C. for 40 Seconds Minimum Density |
|---|---|---|---|---|
| W (Present Invention) | 2.06 | 0.11 | 2.12 | 0.21 |
| X (Comparison) | 2.10 | 0.12 | 2.19 | 0.38 |

It can be understood from the results shown in Table 7 that the compound according to the present invention has a large effect on stopping development when it is incorporated into a protective layer of a light-sensitive material.

EXAMPLE 8

A mixture of 10 g of Dye Providing Substance (6) described below, 0.5 g of succinic acid 2-ethylhexyl ester sulfonic acid sodium salt, 10 g of tricresyl phosphate and 20 ml of cyclohexanone was dissolved by heating at 60° C. to prepare a uniform solution. The solution was mixed with 100 g of a 10% aqueous solution of lime processed gelatin by stirring and the mixture was dispersed by means of a homogenizer to prepare a dispersion of dye providing substance.

Dye Providing Substance (6):

-continued

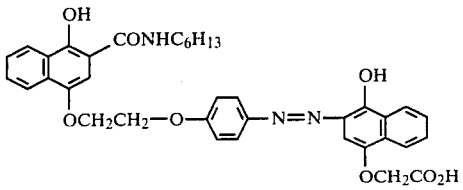

Light-Sensitive Material 701 was prepared in the following manner.

| | |
|---|---|
| (a) Silver iodobromide emulsion (the same as described in Example 1) | 5.5 g |
| (b) 10% Aqueous solution of gelatin | 0.5 g |
| (c) Dispersion of Dye Providing Substance (6) (described above) | 2.5 g |
| (d) 10% Ethanol solution of guanidine trichloroacetate | 1 ml |
| (e) 10% Methanol solution of 2,6-dichloro-4-aminophenol | 0.5 ml |
| (f) 5% Aqueous solution of a compound having the following formula: 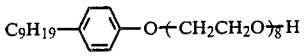 | 1 ml |
| (g) Gelatin dispersion of Compound (20) according to the present invention (the same as described in Example 1) | 3 ml |
| (h) Water | 6 ml |

The above components (a) to (h) were mixed and dissolved by heating and the mixture was coated on a polyethylene terephthalate film at a wet layer thickness of 85 μm and dried. On the thus formed layer, a protecting layer containing 1.5 g/m$^2$ of gelatin was provided and dried, whereupon Light-Sensitive Material 701 was prepared.

Light-Sensitive Material 701 thus obtained was subjected to light exposure and processing in the same manner as described in Example 1 and the results shown in Table 8 were obtained.

TABLE 8

| Light-Sensitive Material | Heating at 140° C. for 30 Seconds | | Heating at 140° C. for 40 Seconds | |
|---|---|---|---|---|
| | Maximum Density | minimum Density | Maximum Density | Minimum Density |
| 701 | 1.95 | 0.14 | 1.98 | 0.21 |

From the results shown in Table 8 it can be recognized that the compound according to the present invention also exhibits the remarkable effects of the present invention in a light-sensitive material containing a dye providing substance which releases a dye upon coupling reaction with the oxidation product of a developing agent.

EXAMPLE 9

A mixture of 5 g of Dye Providing Substance (7) having the structure shown below, 4 g of an electron donor having the structure shown below, 0.5 g of succinic acid 2-ethylhexyl ester sulfonic acid sodium salt, 10 g of tricresyl phosphate and 20 ml of cyclohexanone was dissolved by heating at about 60° C. Then, the same procedure as described in Example 8 was carried out to prepare a dispersion of dye providing substance capable of being reduced.

Dye Providing Substance (7):

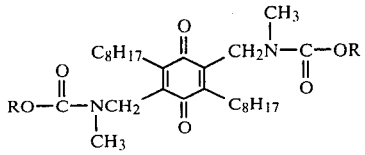

R: 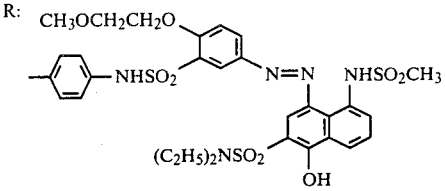

Electron Donor:

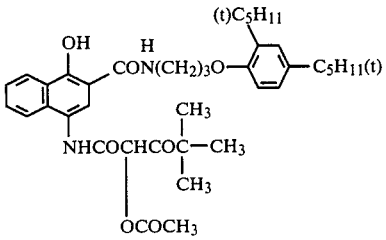

Light-Sensitive Material 801 was prepared in the same manner as described for Light-Sensitive Material 701 in Example 8 except using the above described dispersion of dye providing substance capable of being reduced in place of the dispersion of Dye Providing Substance (6).

Light-Sensitive Material 801 thus obtained was subjected to light exposure and processing in the same manner as described in Example 1 and the results shown in Table 9 were obtained.

TABLE 9

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| 801 | 1.72 | 0.18 | 1.78 | 0.22 |

From the results shown in Table 9 it can be recognized that the compound according to the present invention also exhibits good effect in a light-sensitive material containing a dye providing substance which is capable of being reduced and providing a positive image with respect to a silver image.

EXAMPLE 10

A method of preparing a gelatin dispersion of a coupler is described in the following.

A mixture of 5 g of 2-dodecylcarbamoyl-1-naphthol (Dye Providing Substance (8)), 0.5 g of succinic acid 2-ethylhexyl ester sulfonic acid sodium salt, 2.5 g of tricresyl phosphate (TCP) and 30 ml of ethyl acetate was dissolved. The solution was mixed with 100 g of a 10% aqueous solution of gelatin by stirring and the mixture was dispersed by means of a homogenizer at 10,000 rpm for 10 minutes.

Light-Sensitive Material 901 was prepared in the following manner.

| | | |
|---|---|---|
| (a) | Silver iodobromide emulsion (the same as described in Example 1) | 10 g |
| (b) | Gelatin dispersion of coupler (described above) | 3.5 g |
| (c) | Solution containing 0.25 g of guanidine trichloroacetate dissolved in 2.5 ml of ethanol | |
| (d) | 10% Aqueous solution of gelatin | 5 g |
| (e) | Solution containing 0.2 g of 2,6-dichloro-p-aminophenol dissolved in 15 ml of water | |
| (f) | Gelatin dispersion of Compound (20) according to the present invention (the same as described in Example 1) | 2 ml |

A coating solution having the composition shown above was coated on a polyethylene terephthalate film support at a wet layer thickness of 60 μm and dried, whereupon Light-Sensitive Material 901 was prepared.

Light-Sensitive Material 901 thus obtained was imagwise exposed for 5 seconds at 2,000 lux using a tungsten lamp and then uniformly heated for 20 seconds or 30 seconds on a heated block heated at 150° C., whereupon a negative cyan color image was obtained.

Negative image density was measured by means of a Macbeth transmission densitometer (TD-504). The results thus obtained are shown in Table 10.

TABLE 10

| Light-Sensitive Material | Heating at 150° C. for 20 Seconds | | Heating at 150° C. for 30 Seconds | |
|---|---|---|---|---|
| | Maximum Density | Minimum Density | Maximum Density | Minimum Density |
| 901 | 2.08 | 0.21 | 2.14 | 0.29 |

From the results shown in Table 10 it can be understood that the compound according to the present invention exhibits a large effect on stopping development.

EXAMPLE 11

In this example, a black-and-white system is illustrated.

Light-Sensitive Material 1001 was prepared in the following manner.

| | | |
|---|---|---|
| (a) | Silver iodobromide emulsion (the same as described in Example 1) | 1 g |
| (b) | Silver benzotriazole emulsion (the same as described in Example 1) | 10 g |
| (c) | 10% Ethanol solution of guanidine trichloroacetate | 1 ml |
| (d) | 5% Methanol solution of a compound having the following formula: 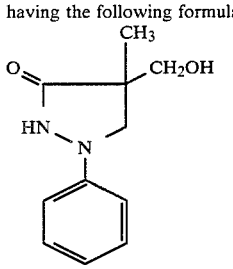 | 2 ml |
| (e) | Gelatin dispersion of Compound (20) according to the present invention (the same as described in Example 1) | 1 ml |

A coating solution having the composition shown above was coated on a polyethylene terephthalate film support at a wet layer thickness of 60 μm and dried, whereupon Light-Sensitive Material 1001 was prepared.

Light-Sensitive Material 1001 thus obtained was imagewise exposed for 5 seconds at 2,000 lux using a tungsten lamp and then uniformly heated for 30 seconds or 40 seconds on a heated block heated at 130° C., whereupon a negative brown image was obtained.

Negative image density was measured by means of a Macbeth transmission densitometer (TD-504). The results thus obtained are shown in Table 11.

TABLE 11

| Light-Sensitive Material | Heating at 130° C. for 30 Seconds | | Heating at 130° C. for 40 Seconds | |
|---|---|---|---|---|
| | Maximum Density | Minimum Density | Maximum Density | Minimum Density |
| 1001 | 0.79 | 0.12 | 0.83 | 0.19 |

From the results shown in Table 11 it can be understood that the compound according to the present invention exhibited the large effect on stopping development.

EXAMPLE 12

A method of preparing a gelatin dispersion of a dye providing substance is described in the following.

A mixture of 5 g of Dye Providing Substance (A), (B) or (C) described below, 0.5 g of succinic acid 2-ethylhexyl ester sulfonic acid sodium salt as a surface active agent, 5 g of tricresyl phosphate (TCP) and 30 ml of ethyl acetate was dissolved by heating at about 60° C. The solution was mixed with 100 g of a 10% aqueous solution of gelatin, and the mixture was dispersed by means of a homogenizer at 10,000 rpm for 10 minutes. The dispersions thus obtained were designated as dispersion of yellow, magenta or cyan dye providing substance, respectively.

Yellow Dye Providing Substance (A)

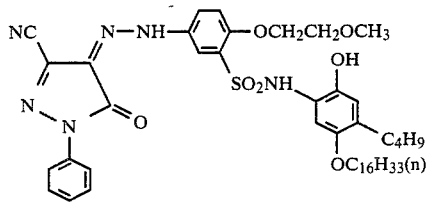

Magenta Dye Providing Substance (B)

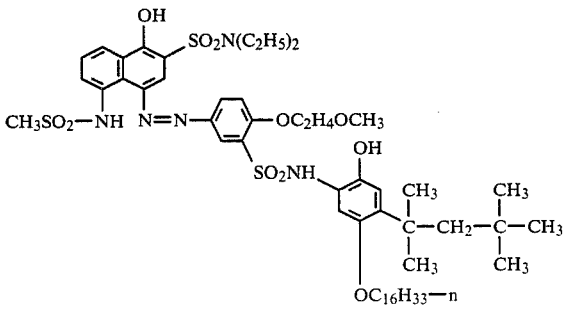

Cyan Dye Providing Substance (C)

-continued

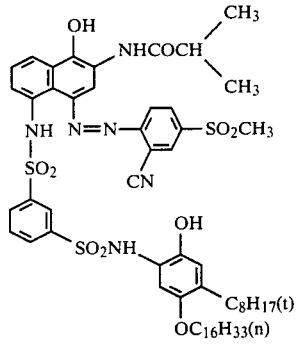

A method of preparing a gelatin dispersion of the compound according to the present invention is described in the following.

3 g of Compound (76) according to the present invention was added to 100 g of a 1% aqueous solution of gelatin, and the mixture was ground in a mill using 100 g of glass beads having an average diameter of about 0.6 mm for 10 minutes. By removing the glass beads by filtration, a gelatin dispersion of the compound according to the present invention was obtained.

A multilayer Light-Sensitive Material 1101 having the structure described below was prepared.

| | |
|---|---|
| 6th Layer: | Gelatin (coating amount: 1,000 mg/m$^2$)<br>Base precursor *3 (coating amount: 220 mg/m$^2$)<br>Compound of the present invention (76) (coating amount: 10 mg/m$^2$) |
| 5th Layer: (blue-sensitive layer) | Silver iodobromide emulsion (the same as described in Example 1) (coating amount: 400 mg Ag/m$^2$)<br>Following compound *4 (coating amount: 180 mg/m$^2$)<br>Base precursor *3 (coating amount: 520 mg/m$^2$)<br>Compound of the present invention (76) (coating amount: 5 mg/m$^2$)<br>Yellow dye providing substance (1) (coating amount: 400 mg/m$^2$)<br>Gelatin (coating amount: 1,000 mg/m$^2$)<br>Organic solvent having high boiling point *1 (coating amount: 800 mg/m$^2$)<br>Surface active agent *2 (coating amount: 100 mg/m$^2$)<br>Following compound *5 (coating amount: 24 mg/m$^2$) |
| 4th Layer: | Gelatin (coating amount: 1,200 mg/m$^2$)<br>Base precursor *3 (coating amount: 220 mg/m$^2$)<br>Compound of the present invention (76) (coating amount: 10 mg/m$^2$) |
| 3rd Layer: (green-sensitive layer) | Silver iodobromide emulsion (the same as described in Example 1) (coating amount: 400 mg Ag/m$^2$)<br>Sensitizing dye (L-1) (coating amount: $10^{-6}$ mol/m$^2$)<br>Following compound *4 (coating amount: 180 mg/m$^2$)<br>Base precursor *3 (coating amount: 515 mg/m$^2$)<br>Compound of the present invention (76) (coating amount: 5 mg/m$^2$)<br>Magenta dye providing substance (2) (coating amount: 400 mg/m$^2$)<br>Gelatin (coating amount: 1,000 mg/m$^2$)<br>Organic solvent having high boiling point *1 (coating amount: 800 mg/m$^2$)<br>Surface active agent *2 (coating amount: 100 mg/m$^2$)<br>following compound *5 (coating amount: 24 mg/m$^2$) |
| 2nd Layer: | Gelatin (coating amount: 1,000 mg/m$^2$)<br>Base precursor *3 (coating amount: 230 mg/m$^2$)<br>Compound of the present invention (76) (coating amount: 10 mg/m$^2$) |

-continued

| | |
|---|---|
| 1st Layer: (red-sensitive layer) | Silver iodobromide emulsion (the same as described in Example 1) (coating amount: 400 mg Ag/m$^2$)<br>Sensitizing dye (L-2) (coating amount: ($8 \times 10^{-7}$ mol/m$^2$)<br>Following compound *4 (coating amount: 180 mg/m$^2$)<br>Base precursor *3 (coating amount: 515 mg/m$^2$)<br>Compound of the present invention (76) (coating amount: 5 mg/m$^2$)<br>Cyan dye providing substance (3) (coating amount: 300 mg/m$^2$)<br>Gelatin (coating amount: 1,000 mg/m$^2$)<br>Organic solvent having high boiling point *1 (coating amount: 600 mg/m$^2$)<br>Surface active agent *2 (coating amount: 100 mg/m$^2$)<br>Following compound *5 (coating amount: 18 mg/m$^2$) |
| Support: | (Polyethylene terephthalate film) |

*1: $(iso\text{-}C_9H_{19}O)_3P{=}O$

*2: 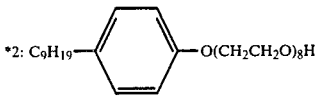

*3: 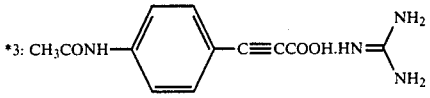

*4: 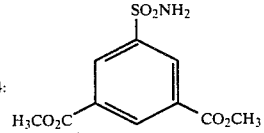

*5: 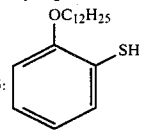

Light-Sensitive Material 1102 or 1103 was prepared in the same manner as described for Light-Sensitive Material 1101 except using Compound (51) or (52) of this invention in place of Compound (76), respectively. For comparison, Light-Sensitive Material 1104 was prepared in the same manner as described for Light-Sensitive Material 1101 except omitting the compound of this invention.

A method of preparing an image receiving material having an image receiving layer is described in the following.

7.5 g of Gelatin Hardener H-1, 0.25 g of Gelatin Hardener H-2, 160 ml of water and 100 g of lime-processed gelatin were mixed uniformly. The mixture was coated on a polyethylene terephthalate film at a wet layer thickness of 60 μm and dried.

Gelatin Hardener H-1:

$$CH_2{=}CHSO_2CH_2CONH\text{-}(CH_2)_2NHCOCH\text{-}{}_2SO_2CH{=}CH_2$$

Gelatin Hardener H-2:

$$CH_2{=}CHSO_2CHCONH\text{-}(CH_2)_3NHCOCH\text{-}{}_2SO_2CH{=}CH_2$$

15 g of a polymer having the following structure was dissolved in 200 ml of water. This solution was uniformly mixed with 100 g of a 10% aqueous gelatin solution. This mixture was coated on the above described coated layer at a wet layer thickness of 80 μm and dried to obtain an image receiving material.

Polymer:

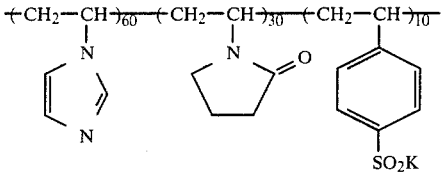

Each of the light-sensitive materials described above was exposed to light for 10 seconds at 2,000 lux through a continuous optical wedge using a tungsten lamp and then uniformly heated for 20 seconds on a heat block heated at 150° C. or 153° C.

The image receiving material was soaked in water and then superimposed on each of the above heated light-sensitive materials in such a manner that their coated layers were in contact with each other.

After heating for 6 seconds on a heat block maintained at 80° C., the image receiving material was separated from the light-sensitive material, whereupon a negative dye image was obtained on the image receiving material.

Negative image density was measured by means of a Macbeth reflective densitometer (RD-519). The results thus obtained are shown in Table 12.

TABLE 12

| Sample No. | Compound No. | Filter | Heating at 150° C., 20 Seconds: Maximum Density | Heating at 150° C., 20 Seconds: Minimum Density | Heating at 153° C., 20 Seconds: Maximum Density | Heating at 153° C., 20 Seconds: Minimum Density |
|---|---|---|---|---|---|---|
| 1101 | (76) | B | 1.93 | 0.15 | 1.95 | 0.17 |
| | | G | 2.00 | 0.18 | 2.03 | 0.20 |
| | | R | 2.11 | 0.16 | 2.13 | 0.19 |
| 1102 | (51) | B | 1.90 | 0.12 | 1.94 | 0.13 |
| | | G | 1.98 | 0.15 | 2.03 | 0.17 |
| | | R | 2.06 | 0.14 | 2.10 | 0.17 |
| 1103 | (53) | B | 1.94 | 0.18 | 1.97 | 0.20 |
| | | G | 2.02 | 0.17 | 2.06 | 0.18 |
| | | R | 2.10 | 0.16 | 2.13 | 0.19 |
| 1104 | None | B | 1.95 | 0.18 | 2.03 | 0.31 |
| | | G | 2.04 | 0.20 | 2.16 | 0.41 |
| | | R | 2.12 | 0.17 | 2.30 | 0.29 |

It is apparent from the results shown in Table 12 that the increases in the maximum density and minimum density are small even when the developing temperature is increased by 3° C. due to the use of the compound according to the present invention. On the contrary, in the comparative sample which did not contain the compound, a remarkable increase of fog was observed. Therefore, it can be understood that the compound according to the present invention has a large effect on stopping development.

EXAMPLE 13

A method of preparing a silver halide emulsion for a fifth layer is described below.

In 1,000 ml of water were dissolved 20 g of gelatin and ammonia, and the solution was kept at 50° C. with stirring. To the gelatin aqueous solution were added simultaneously 1,000 ml of an aqueous solution containing potassium iodide and potassium bromide and a solution of 1 mol of silver nitrate in 1,000 ml of water while maintaining a pAg constant to thereby prepare a mono-dispersed emulsion of octahedron silver iodobromide having an average grain size of 0.5 μm (iodine content: 5 mol%).

After washing with water and desalting, 5 mg of chloroauric acid tetrahydrate and 2 mg of sodium thiosulfate were added to the emulsion to carry out gold-sulfur sensitization at 60° C. The yield of the emulsion was 1.0 Kg.

A method of preparing an emulsion for a third layer is described below.

In 1,000 ml of water were dissolved 20 g of gelatin and 3 g of sodium chloride, and the solution was kept at 75° C. while stirring. To the aqueous gelatin solution were added dropwise simultaneously 600 ml of an aqueous solution containing sodium chloride and potassium bromide, a solution of 0.59 mol of silver nitrate in 600 ml of water and Dye Solution (I) shown below over 40 minutes at the same rate of dropping. There was prepared a mono-dispersed emulsion of cubic silver chlorobromide having an average grain size of 0.35 μm (bromine content: 80 mol%) having adsorbed thereon a dye.

After washing with water and desalting, 5 mg of sodium thiosulfate and 20 mg of 4-hydroxy-6-methyl-1,3,3a,7-tetraazaindene were added to the emulsion to carry out chemical sensitization at 60° C. The yield of the emulsion was 600 g.

Dye Solution (I):

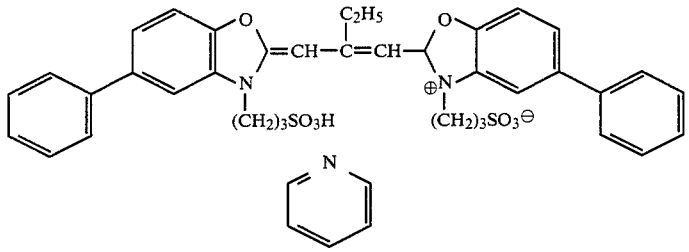

160 ml
Methanol 400 ml

A method of preparing an emulsion for a first layer is described below.

In 1,000 ml of water were dissolved 20 g of gelatin and 3 g of sodium chloride, and the solution was maintained at 75° C. with stirring. To the gelatin aqueous solution were added dropwise simultaneously 600 ml of an aqueous solution containing sodium chloride and potassium bromide and a solution of 0.59 mol of silver nitrate in 600 ml of water over 40 minutes at the same rate of dropping to prepare a mono-dispersed emulsion of cubic silver chlorobromide having an average grain size of 0.35 μm (bromine content: 80 mol%).

After washing with water and desalting, 5 mg of sodium thiosulfate and 20 mg of 4-hydroxy-6-methyl-1,3,3a,7-tetraazaindene were added to the emulsion to carry out chemical sensitization at 60° C. to obtain 600 g of the emulsion.

A silver benzotriazole emulsion was prepared in the same manner as described in Example 1.

A multi-layer color light-sensitive material having a layer structure shown below (Sample 1201) was produced.

| | |
|---|---|
| Sixth Layer: | |
| Gelatin | 740 mg/m$^2$ |
| Base precursor (A)*1 | 250 mg/m$^2$ |
| Fifth Layer | |
| (Blue-Sensitive Emulsion Layer): | |
| Silver iodobromide emulsion (iodine content: 5 mol %) | 500 mg-Ag/m$^2$ |
| Benzenesulfamide | 160 mg/m$^2$ |
| Base precursor (A)*1 | 270 mg/m$^2$ |
| Silver benzotriazole emulsion | 300 mg-Ag/m$^2$ |
| Yellow Dye Providing Substance (1) | 400 mg/m$^2$ |
| Gelatin | 1200 mg/m$^2$ |
| High boiling solvent*2 | 700 mg/m$^2$ |
| Surface active agent*3 | 70 mg/m$^2$ |
| Fourth Layer (Intermediate Layer): | |
| Gelatin | 700 mg/m$^2$ |
| Base precursor (A)*1 | 240 mg/m$^2$ |
| Third Layer | |
| (Green-Sensitive Emulsion Layer): | |
| Silver chlorobromide emulsion (bromine content: 80 mol %) | 200 mg-Ag/m$^2$ |
| Benzenesulfamide | 140 mg/m$^2$ |
| Silver benzotriazole emulsion | 100 mg-Ag/m$^2$ |
| Base Precursor (A)*1 | 210 mg/m$^2$ |
| Magenta Dye Providing Substance (2) | 330 mg/m$^2$ |
| Gelatin | 860 mg/m$^2$ |
| High boiling solvent*2 | 430 mg/m$^2$ |
| Surface active agent*3 | 60 mg/m$^2$ |
| Second Layer (Intermediate Layer): | |
| Gelatin | 1000 mg/m$^2$ |
| Base precursor (A)*1 | 240 mg/m$^2$ |
| First Layer | |
| (Red-Sensitive Emulsion Layer): | |
| Silver chlorobromide emulsion (bromine content: 80 mol %) | 200 mg-Ag/m$^2$ |
| Benzenesulfamide | 140 mg/m$^2$ |
| Sensitizing dye*4 | $8 \times 10^{-7}$ mol/m$^2$ |
| Silver benzotriazole emulsion | 230 mg-Ag/m$^2$ |
| Base precursor (A)*1 | 230 mg/m$^2$ |
| Cyan Dye Providing Substance (3) | 300 mg/m$^2$ |
| Gelatin | 850 mg/m$^2$ |
| High boiling solvent*2 | 540 mg/m$^2$ |
| Surface active agent*3 | 60 mg/m$^2$ |
| Support: | |

-continued

| |
|---|
| Polyethylene terephthalate film |

Note:

*1:

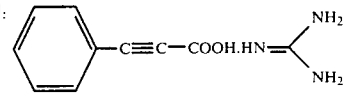

*2: (iso:$C_9H_{19}O)_3P{=}O$

*3:

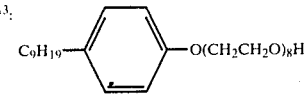

*4:

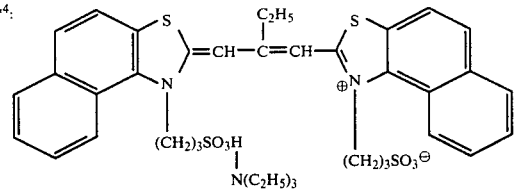

A method of preparing a dye-fixing material is described below.

Twelve grams of lime-processed gelatin was dissolved in 200 ml of water, and 16 ml of a 0.5M aqueous solution of zinc acetate was added thereto, followed by uniformly mixing. The resulting mixture was uniformly coated on a 100 μm thick white film support comprising polyethylene terephthalate containing titanium dioxide to a wet thickness of 85 μm. A coating composition having the following formulation (1) or (2) was then uniformly coated on the coating film to a wet thickness of 90 μm and dried to prepare a dye-fixing material.

| Coating Composition Formulation (1): | |
|---|---|
| 10% aqueous solution of polyvinyl alcohol (degree of polymerization: 2000) | 120 g |
| Urea | 20 g |
| N—Methylurea | 20 g |
| 12% aqueous solution of a compound having the following formula: | 80 g |

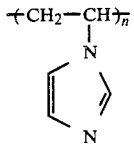

(intrinsic viscosity in 1% aqueous solution of NaCl at 30° C.: 0.1726)

| | |
|---|---|
| Gelatin dispersion of Compound (76) (the same as described in Example 12) | 60 ml |

| Coating Composition Formulation (2): | |
|---|---|
| 10% aqueous solution of polyvinyl alcohol (degree of polymerization: 2000) | 120 g |
| Urea | 20 g |
| N—Methylurea | 20 g |
| 12% aqueous solution of a compound having the following formula: | 80 g |

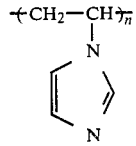

-continued

| Coating Composition Formulation (2): | |
|---|---|
| Water | 6 ml |

Each of the thus prepared multi-layer color light-sensitive materials was exposed to light for 1 second using a tungsten lamp (2,000 lx) through separation filteres B, G and R having continuously varying temperatures. The exposed material was then uniformly heated on a heat block heated at 140° C. for 30 seconds.

The light-sensitive material and the above-described dye-fixing material were brought into contact so that the coating layers faced to each other and passed through a pair of heat press rollers at 130° C. and, immediately thereafter, heated on a heat block at 120° C. for 30 seconds. Immediately after the heating, the dye-fixing material was peeled apart from the light-sensitive material. There were obtained on the dye-fixing material yellow, magenta and cyan images in correspondence to the separation filters B, G and R, respectively. The maximum density ($D_{max}$) and minimum density ($D_{min}$) of each color image were measured using a Macbeth reflective densitometer (RD-519). The results obtained are shown in Table 13

TABLE 13

| Separation | Coating Composition (1) (Invention) | | Coating Composition (2) (Comparison) | |
|---|---|---|---|---|
| Filter | $D_{max}$ | $D_{min}$ | $D_{max}$ | $D_{min}$ |
| B | 1.87 | 0.19 | 1.90 | 0.28 |
| G | 2.10 | 0.20 | 2.12 | 0.32 |
| R | 2.23 | 0.15 | 2.25 | 0.29 |

It can be seen from Table 13 above that the compound of the present invention, when added to a dye-fixing layer, is effective to inhibit increase in fog during the transfer processing.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a light-sensitive silver halide layer, wherein a compound represented by general formula (I) described below is in the light-sensitive silver halide layer or an image receiving layer thereof and a binder:

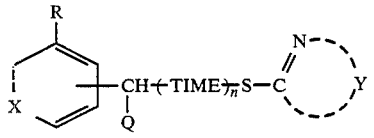

(I)

wherein X represents an atomic group necessary to complete a benzene ring or a naphthalene ring; R represents a group convertible to a hydroxy group or a dissociation form thereof at the time of heat-development; Y represents an atomic group necessary to complete a 5-membered or 6-membered heterocyclic group containing at least one nitrogen atom; Q represents a hydrogen atom, an alkyl group, a substituted alkyl group, an aryl group, or a substituted aryl group; TIME represents a timing group; and n represents 0 or a positive integer, wherein the heat-developable light-sensitive material further contains an organic silver salt oxidizing agent.

2. The heat-developable light-sensitive material as claimed in claim 1, wherein the binder is gelatin.

3. The heat-developable light-sensitive material is claimed in claim 2, wherein the heat-developable light-sensitive material further comprises a base or base precursor.

4. The heat-developable light-sensitive material as claimed in claim 3, wherein the heat-developable light-sensitive material further comprises a nucleophilic reagent.

5. An image forming process which comprises imagewise exposing and then heat-development processing a heat-developable light-sensitive material comprising a light-sensitive silver halide layer, wherein a compound represented by general formula (I) described below is in the light-sensitive silver halide layer or an image receiving layer thereof and a binder:

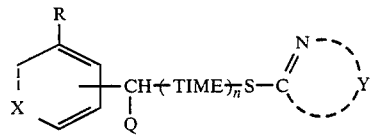

(I)

wherein X represents an atomic group necessary to complete a benzene ring or a naphthalene ring; R represents a group convertible to a hydroxy group or a dissociation form thereof at the time of heat-development; Y represents an atomic group necessary to complete a 5-membered or 6-membered heterocyclic group containing at least one nitrogen atom; Q represents a hydrogen atom, an alkyl group, a substituted alkyl group, an aryl group, or a substituted aryl group; TIME represents a timing group; and n represents 0 or a positive integer, wherein the heat-developable light-sensitive material further contains an organic silver salt oxidizing agent.

6. A process as claimed in claim 5, wherein heat-development is by heating at a temperature to above 80° C.

7. A process as claimed in claim 6, wherein the heat-developable light-sensitive material further comprises a base or a base precursor.

8. A process as claimed in claim 7, wherein the binder is gelatin.

9. A process as claimed in claim 7, wherein the heat-developable light-sensitive material further comprises a nucleophilic reagent.

* * * * *